US007811512B2

(12) United States Patent
Sakata et al.

(10) Patent No.: US 7,811,512 B2
(45) Date of Patent: Oct. 12, 2010

(54) METHOD FOR PRODUCING SINTERED BODY AND SINTERED BODY

(75) Inventors: Masaaki Sakata, Matsumoto (JP); Junichi Hayashi, Okaya (JP)

(73) Assignee: Seiko Epson Corporation (JP)

( * ) Notice: Subject to any disclaimer, the term of this patent is extended or adjusted under 35 U.S.C. 154(b) by 403 days.

(21) Appl. No.: 11/903,535

(22) Filed: Sep. 21, 2007

(65) Prior Publication Data

US 2008/0075620 A1 Mar. 27, 2008

(30) Foreign Application Priority Data

Sep. 22, 2006 (JP) ..... 2006-257579
Sep. 22, 2006 (JP) ..... 2006-257580

(51) Int. Cl.
*B22F 3/12* (2006.01)

(52) U.S. Cl. ..... 419/37; 419/41

(58) Field of Classification Search ..... 419/36, 419/27, 37, 41
See application file for complete search history.

(56) References Cited

U.S. PATENT DOCUMENTS

| | | | | |
|---|---|---|---|---|
| 4,795,598 | A * | 1/1989 | Billiet | 264/40.6 |
| 5,032,354 | A * | 7/1991 | Nakanishi et al. | 419/23 |
| 5,080,846 | A * | 1/1992 | Kim et al. | 264/109 |
| 5,332,537 | A * | 7/1994 | Hens et al. | 264/496 |
| 5,362,791 | A * | 11/1994 | Ebenhoech et al. | 524/440 |
| 5,531,958 | A * | 7/1996 | Krueger | 419/44 |
| 5,746,960 | A * | 5/1998 | Kasai et al. | 264/234 |
| 5,860,055 | A * | 1/1999 | Hesse et al. | 419/36 |
| 6,051,184 | A * | 4/2000 | Kankawa | 419/36 |
| 6,682,582 | B1 * | 1/2004 | Speidel | 75/252 |
| 6,846,862 | B2 * | 1/2005 | Schofalvi et al. | 524/195 |
| 2003/0164570 | A1 * | 9/2003 | Arrimadas Matias | 264/82 |
| 2006/0099103 | A1 * | 5/2006 | Wohlfromm et al. | 419/23 |

FOREIGN PATENT DOCUMENTS

| | | |
|---|---|---|
| CN | 1559984 | 1/2005 |
| EP | 0 413 231 | 6/1993 |
| JP | 05-043304 | 2/1993 |
| JP | 06-263548 | 9/1994 |
| JP | B-3128130 | 11/2000 |
| JP | 2006-265659 | 10/2006 |
| JP | 2006-265660 | 10/2006 |
| JP | 2006-265661 | 10/2006 |
| JP | 2006-283159 | 10/2006 |

* cited by examiner

*Primary Examiner*—Roy King
*Assistant Examiner*—Ngoclan T Mai
(74) *Attorney, Agent, or Firm*—Harness, Dickey & Pierce, P.L.C.

(57) ABSTRACT

A method for producing a sintered body is provided. The method for producing the sintered body comprising: forming a green body by molding a composition for forming a green body into a specified shape to obtain the green body, the composition comprising powder constituted of a metallic material and a binder containing a first resin which is decomposable by ozone; first debinding the green body by exposing the green body to a high ozone content atmosphere to decompose the first resin and remove the decomposed first resin form the green body to obtain a brown body; exposing the thus obtained brown body at least once to a low ozone content atmosphere whose ozone concentration is lower than an ozone concentration of the high ozone content atmosphere to obtain an intermediate brown body; and sintering the intermediate brown body which has been exposed to the low ozone content atmosphere to obtain the sintered body. By using the composition mentioned above, it is possible to safely, easily and cost-effectively produce a metal sintered body having a reduced metal oxide amount and improved properties (dimensional accuracy). Such a sintered body is also provided.

24 Claims, 9 Drawing Sheets

METHOD FOR PRODUCING SINTERED BODY AND SINTERED BODY

CROSS-REFERENCE TO RELATED APPLICATION

This application claims priorities to Japanese Patent Application No. 2006-257579 filed on Sep. 22, 2006 and No. 2006-257580 filed on Sep. 22, 2006, which are hereby expressly incorporated by reference herein in their entireties.

BACKGROUND

1. Technical Field

The present invention relates to a method for producing a sintered body and a sintered body.

2. Related Art

A metallic sintered body is typically produced by forming raw powder (mixed powder), i.e., a mixture of metal powder and a binder, into a green body by use of various kinds of forming methods such as an injection molding method or the like, debinding the green body at a temperature higher than a melting point of the binder but lower than a sintering point of the metal powder to thereby obtain a brown body, and sintering the brown body thus obtained.

In the meantime, the raw powder used in, e.g., an injection molding method, contains a binder in a relatively large quantity in order to improve flowability during the injection molding process. Therefore, a heating operation needs to be performed for an extended period of time to remove the binder. This poses a problem in that the production efficiency of a sintered body is lowered and deformation occurs in a green body during the heating operation.

Furthermore, it is impossible for the heating operation to completely remove the binder contained in the green body. This poses another problem in that vaporization of a residual binder in a sintering process creates cracks in the sintered body.

In an effort to solve these problems, there has been disclosed a method for producing a brown body which is obtained by heating a green body constituted of a raw powder being a mixture of metal powder and a binder containing polyacetal in a gaseous acid-contain atmosphere or a boron trifluoride contain atmosphere (see, e.g., Japanese Patent No. 3,128,130).

In general, acid is one of deleterious substances, and boron trifluoride is one of poisonous substance and therefore is detrimental to a human body. For this reason, the task of handling acid involves a great deal of toil, which is partly attributable to the necessity of using a heavy protection device.

Moreover, acid and boron trifluoride have a strong property of dissolving metal. This requires use of a highly corrosion-resistant material in the equipments for production of a metal brown body, which makes the metal brown body costly to produce.

In addition, acid becomes a cause of air pollution when it is discharged to the air at the end of a heating operation. This means that there is a need to prevent acid from being discharged to the air. However, it is costly to prevent the discharge of acid to the air.

SUMMARY

Accordingly, it is an object of the present invention to provide: a method for producing a sintered body that can be safely, easily and cost-effectively produced a metal sintered body having a reduced metal oxide amount and improved properties (dimensional accuracy); and a sintered body of improved properties produced by use of the method for the producing the sintered body.

These objects are achieved by the present invention described below. In a first aspect of the present invention, there is provided a method for producing a sintered body. The method for producing the sintered body comprising: forming a green body by molding a composition for forming a green body into a specified shape to obtain the green body, the composition comprising powder constituted of a metallic material and a binder containing a first resin which is decomposable by ozone; first debinding the green body by exposing the green body to a high ozone content atmosphere to decompose the first resin and remove the decomposed first resin form the green body to obtain a brown body; exposing the thus obtained brown body at least once to a low ozone content atmosphere whose ozone concentration is lower than an ozone concentration of the high ozone content atmosphere to obtain an intermediate brown body; and sintering the intermediate brown body which has been exposed to the low ozone content atmosphere to obtain the sintered body.

This makes it possible to obtain the metal sintered body having the reduced metal oxide amount and improved properties (dimensional accuracy) that can be safely, easily and cost-effectively produced.

In the method for producing the sintered body according to the present invention, it is preferred that the ozone concentration of the high ozone content atmosphere is 50 to 10,000 ppm.

This makes it possible to easily and quickly decompose the first resin and to easily and quickly remove the decomposed first resin In the method for producing the sintered body according to the present invention, it is preferred that the high ozone content atmosphere is set at a temperature of 20 to 190° C.

This makes it possible to easily and quickly decompose the first resin and to easily and quickly remove the decomposed first resin. This also makes it possible to prevent decreasing of the shape retention of the brown body. As a result, it is possible to reliably prevent a dimensional accuracy of a sintered body finally obtained from being lowered.

In the method for producing the sintered body according to the present invention, it is preferred that the first resin contains at least one of a polyether-based resin, a polylactate-based resin and an aliphatic carbonic ester-based resin.

This makes it possible to easily decompose the first resin by making contact with ozone. These resins exhibit very high wettability with respect to the metal powder. Therefore, it is also possible to sufficiently disperse inorganic material powder even when a kneading operation is performed for a short period of time.

In the method for producing the sintered body according to the present invention, it is preferred that the polyether-based resin contains a polyacetal-based resin as a main component thereof.

When exposed to the ozone-containing atmosphere, the polyacetal-based resin is decomposed into formaldehyde or the like and discharged from the green body. The polyacetal-based resin exhibits very high decomposability, thus making it possible to reliably debind the green body in the first debinding (a first debinding step). Therefore, use of the polyacetal-based resin makes it possible to shorten the time required in completing whole debinding (debinding step).

In the method for producing the sintered body according to the present invention, it is preferred that each of repeating units of the aliphatic carbonic ester-based resin has a carbonic ester group, wherein the number of the carbon atoms contained in the unit other than carbon atoms of the carbonic ester group is 2 to 11.

This makes it possible to easily and quickly decompose the aliphatic carbonic ester-based resin.

In the method for producing the sintered body according to the present invention, it is preferred that the aliphatic carbonic ester-based resin has no unsaturated bond.

This makes it possible to easily decompose the aliphatic carbonic ester-based resin when making contact with ozone. As a result, it becomes possible to efficiently decompose the aliphatic carbonic ester-based resin and remove the decomposed aliphatic carbonic ester-based resin.

In the method for producing the sintered body according to the present invention, it is preferred that the first resin has a weight-average molecular weight of 10,000 to 300,000.

This makes it possible to provide an optimum melting point and an optimum viscosity of the first resin, thus to increase the shape stability (shape retention) of the brown body obtained.

In the method for producing the sintered body according to the present invention, it is preferred that the amount of the first resin contained in the binder is 20 wt % or more.

This makes it possible to reliably provide the effect of decomposing the first resin and removing the decomposed first resin. As a result, it is possible to accelerate the debinding process of the binder as a whole.

In the method for producing the sintered body according to the present invention, it is preferred that the exposing step has at least a first stage and a second stage which is subsequent to the first stage, wherein the low ozone content atmosphere in the second stage of the exposing step contains substantially no ozone.

This makes it possible to keep the green body substantially free from ozone, thereby reliably preventing oxidization of the metallic material contained in the green body. Thus, metal oxide is kept from remaining in the sintered body finally obtained, whereby the sintered body produced exhibits particularly high mechanical strength (toughness or the like).

In the method for producing the sintered body according to the present invention, it is preferred that the low ozone content atmosphere is set at a lower temperature than the temperature of the high ozone content atmosphere.

This makes it possible to reliably suppress the oxidizing action exercised by the ozone in the low ozone content atmosphere. This also makes it possible to suppress the oxidizing action of the metal material contained in the brown body.

In the method for producing the sintered body according to the present invention, it is preferred that the low ozone content atmosphere contains non-oxidizing gas as a main component thereof except for ozone.

This also makes it possible to suppress the oxidizing action of the metal material in the exposing step.

In the method for producing the sintered body according to the present invention, it is preferred that the first debinding step, the exposing step and the sintering step are carried out continuously by using a continuous furnace.

This makes it possible to continuously perform the first debinding step, the exposing step and the sintering step, thereby increasing the sintered body production efficiency. The continuous furnace is also designed to prevent the brown body from being exposed to the air throughout the process of producing the sintered body. Thus, the continuous furnace is able to reliably prevent oxidization of the metallic material contained in the brown body, which would otherwise occur in case of the brown body making contact with the air.

In the method for producing the sintered body according to the present invention, it is preferred that the continuous furnace has a space in which an ozone concentration is decreased from a midway point in a moving direction of the green body and wherein the debinding step and the exposing step are carried out continuously by passing through the green body in the space.

This makes it possible to perform these steps within a shortened period of time.

In the method for producing the sintered body according to the present invention, it is preferred that the ozone concentration in the space changes continuously along the moving direction of the green body.

This makes it possible to reduce the frequency with which the bared particles of the metal powder are exposed to ozone. As a result, it becomes possible to effectively suppress oxidization of the metallic material of which the powder is formed.

In the method for producing the sintered body according to the present invention, it is preferred that the binder further contains a second resin of which thermal decomposition temperature is higher than a melting point of the first resin, wherein the method further comprises second debinding the intermediate brown body which has been exposed to the low ozone content atmosphere by heating the intermediate brown body to decompose the second resin and remove the decomposed second resin from the intermediate brown body.

This makes it possible to divide the debinding step into the first debinding step and the second debinding (second debinding step) performed later than the first debinding step. This also makes it possible to selectively decompose the first resin and the second resin contained in the green body, and to remove (or debind) the decomposed first resin and the decomposed second resin one after another. As a result, it becomes possible to control the debinding progress of the green body, whereby a sintered body having the improved shape retention, i.e., dimensional accuracy, can be produced in an easy and reliable manner.

In the method for producing the sintered body according to the present invention, it is preferred that the heating of the intermediate brown body in the second debinding step is carried out at a temperature of 180 to 600° C.

This makes it possible to efficiently and reliably decompose the second resin and to remove decomposed second resin.

In the method for producing the sintered body according to the present invention, it is preferred that the second debinding step carried out in an atmosphere containing reducing gas as a main component thereof.

This makes it possible to reliably prevent oxidization of the metallic material contained in the brown body exposed to the low ozone content atmosphere. It is also possible to decompose the second resin and to remove the decomposed second resin reliably.

In the method for producing the sintered body according to the present invention, it is preferred that the second resin contains at least one of polystyrene and polyolefin as a main component thereof.

These resins exhibit increased bonding strength in the brown body, thereby reliably preventing deformation of the brown body. Furthermore, these resins exhibit high flowability and are easily decomposed when heated. This makes it easy to debind the green body, as a result of which it becomes possible to produce, with increased reliability, the brown body having improved dimensional accuracy.

In the method for producing the sintered body according to the present invention, it is preferred that the composition further contains an additive, wherein the additive is decomposed together with the second resin, and the decomposed additive is removed together with the decomposed second resin from the intermediate brown body in the second debinding step.

This allows the binder to fulfill the function offered by the additive. This also makes it possible to decompose the additive and remove the decomposed additive without adversely affecting the shape retention and the dimensional accuracy of the brown body.

In the method for producing the sintered body according to the present invention, it is preferred that the additive contains a dispersant for increasing dispersibility of particles of the powder in the composition.

This makes it possible for the particles of the powder to be uniformly dispersed in the first resin and the second resin in the composition. As a result, the brown body obtained and the sintered body obtained exhibits little variation in the properties with increased uniformity.

In the method for producing the sintered body according to the present invention, it is preferred that the dispersant contains higher fatty acid as a main component thereof.

This makes it possible to greatly increase dispersibility of the powder in the composition.

In the method for producing the sintered body according to the present invention, it is preferred that the higher fatty acid has carbon atoms of 16 to 30.

This makes it possible to avoid reduction in formability of the composition for forming the green body, which in turn increases the shape retention of the green body and the brown body. Furthermore, the higher fatty acid becomes easily decomposable even at a relatively low temperature.

In the method for producing the sintered body according to the present invention, it is preferred that the first debinding step, exposing step, the second debinding step and the sintering step are carried out continuously by using a continuous furnace.

This makes it possible to continuously perform the first debinding step, the exposing step, the second debinding step and the sintering step, thereby increasing the sintered body production efficiency.

In the method for producing the sintered body according to the present invention, it is preferred that the green body is formed by an injection molding method or an extrusion molding method in the green body forming step.

In case of using the injection molding method, it is possible to very easily form the brown body having a complex and fine shape by suitably selecting a mold. In case of using the extrusion molding method, it is possible to very easily and cost-effectively form a columnar or plate-like brown body having a desired extrusion surface shape by suitably selecting a mold.

In a second aspect of the present invention, there is provided a sintered body produced by the method for producing the sintered body.

This makes it possible to obtain a metal sintered body having a reduced metal oxide amount and improved properties.

DESCRIPTION OF EXEMPLARY EMBODIMENTS

Hereinafter, a method for producing a sintered body and a sintered body in accordance with the present invention will be described in detail with reference to preferred embodiments illustrated in the accompanying drawings.

Figure 1:
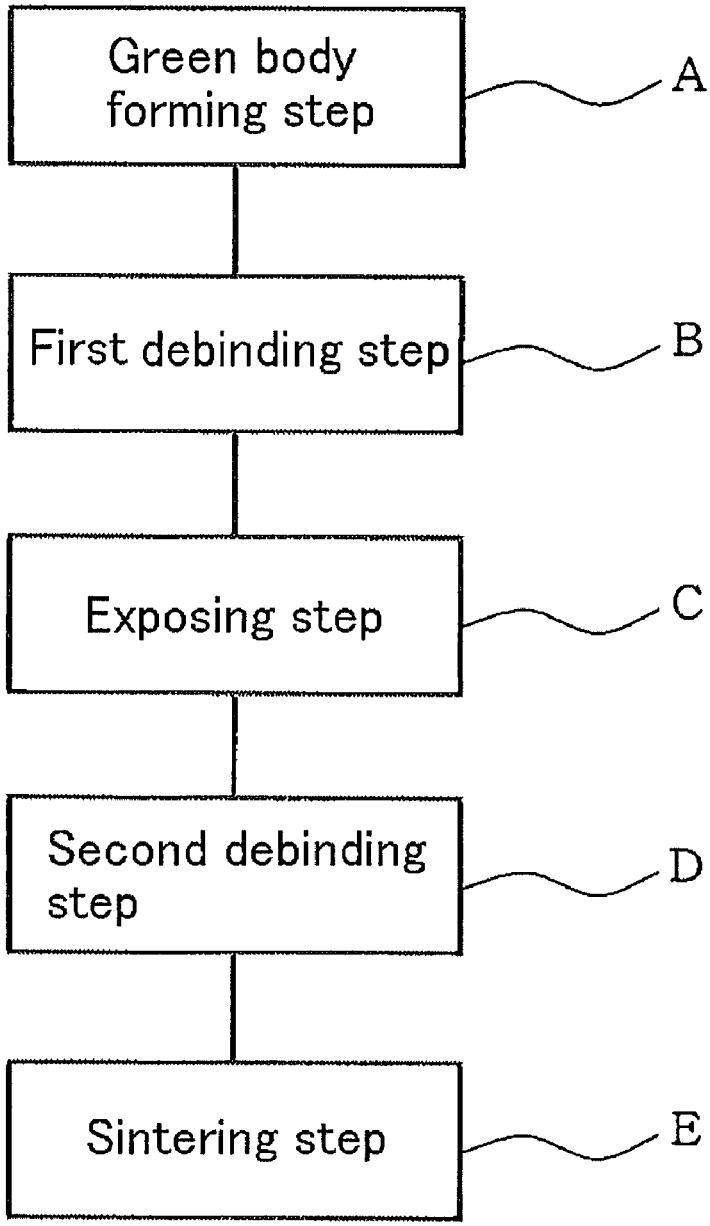
FIG. 1 is a process diagram showing an embodiment of a method for producing a sintered body in accordance with the present invention.
Figure 2:
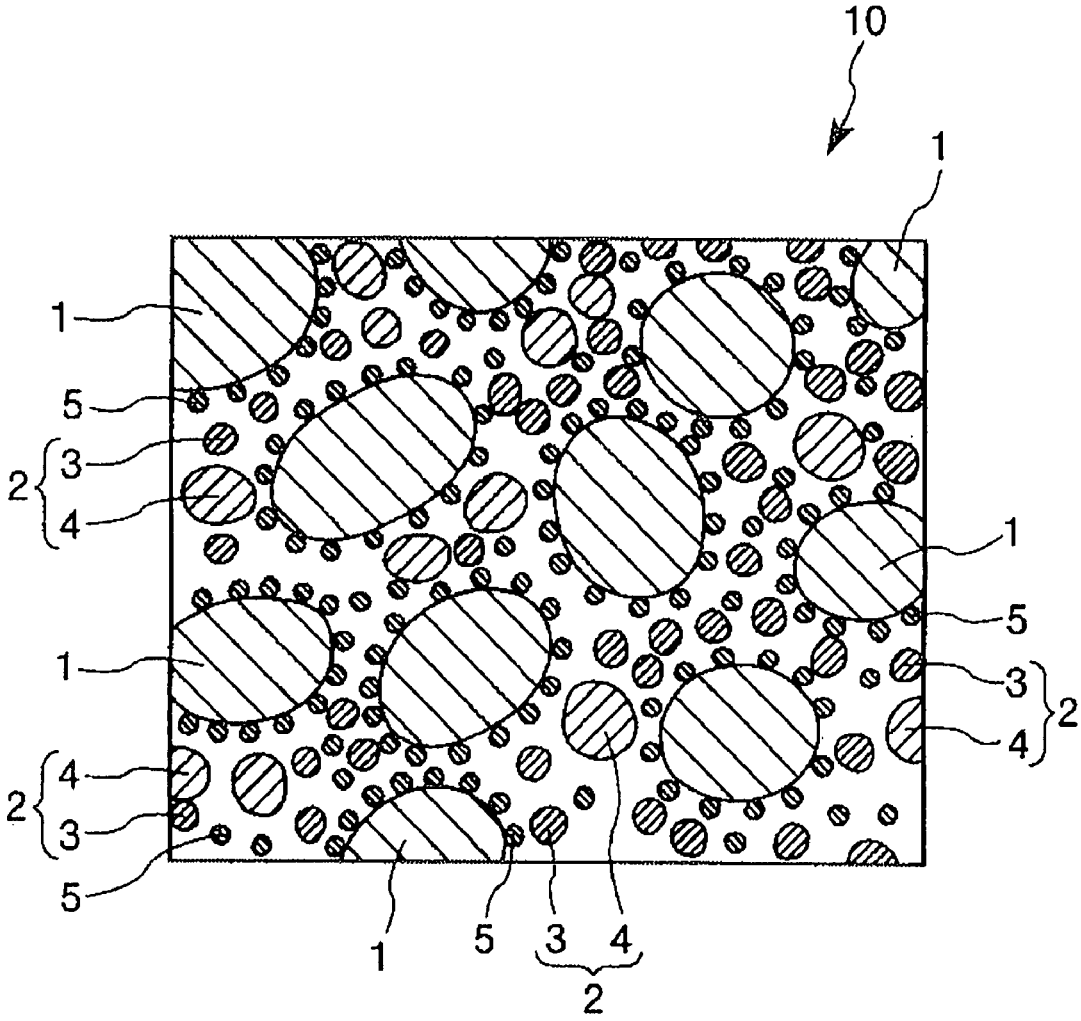
FIG. 2 is a view schematically illustrating a composition for forming a brown body used in an embodiment of a method for producing a sintered body in accordance with the present invention.

FIG. 1 is a process diagram showing an embodiment of a method for producing a sintered in accordance with the present invention. FIG. 2 is a view schematically illustrating a composition for forming a sintered body used in the present embodiment.

Composition for Forming Sintered Body

First, description will be made on a composition (a composition for forming a sintered body) 10 used in the forming the sintered body.

The composition 10 includes powder 1, which is constituted of a metallic material, and a binder (binder resin) 2 which includes a first resin 3

1. Powder

The powder 1 is constituted of the metallic material. Examples of the metallic material include, but are not particularly limited thereto, metal elements such as Fe, Ni, Co, Cr, Mn, Zn, Pt, Au, Ag, Cu, Pd, Al, W, Ti, V, Mo, Nb, Zr, Pr, Nd and Sm or alloys containing these metal elements.

As will be described later, the composition 10 exhibits superior formability. This ensures that a below-mentioned sintered body 50 is reliably produced even when the metallic material having relatively high hardness and low machinability is contained in the composition 10.

Examples of the metallic material noted above include: stainless steel such as SUS (an abbreviation of stainless steel specified in JIS, which holds true hereinbelow) 304 (a classification of stainless steel according to JIS, which holds true hereinbelow), SUS316, SUS316L, SUS317, SUS329J1, SUS410, SUS430, SUS440 and SUS630; Fe-based alloy represented by die steel and high-speed tool steel; Ti or Ti-based alloy; W or W-based alloy; Co-based cemented carbide; and Ni-based cermit. Two or more of these metallic materials may be used in combination.

Combined use of two or more metallic materials of different composition makes it possible to produce the sintered body 50 whose composition cannot be obtained in the conventional casting method. It is also possible to easily produce the sintered body 50 having a novel function or multiple functions. This helps to expand the function and application of the sintered body 50.

The average particle size of the powder 1 is not particularly limited but may be preferably about 0.3 to 100 μm and more preferably about 0.5 to 50 μm. If the average particle size of the powder 1 falls within the above-noted range, it becomes possible to produce the green body 20 with superior formability (ease of shaping).

Furthermore, it is possible to increase the density of the sintered body 50 thus produced. This makes it possible to improve the properties of the sintered body 50 such as mechanical strength and dimensional accuracy.

In contrast, if the average particle size of the powder 1 is smaller than the lower limit value noted above, the green body 20 exhibits inferior formability. If the average particle size of the powder 1 exceeds the upper limit value noted above, it becomes difficult to sufficiently increase the density of the sintered body 50, which may possibly impair the properties of the sintered body 50.

The term "average particle size" as used herein denotes a particle size of the powder distributed in the 50% region of a cumulative volume in a particle size distribution curve for object powder.

The amount of the powder 1 in the composition 10 is not particularly limited but may be preferably about 60 to 98 wt % and more preferably about 70 to 95 wt %. If the amount of the powder 1 falls within the above-noted range, it becomes possible to produce the green body 20 with superior formability (ease of shaping) and eventually to produce the sintered body 50 by debinding and sintering the green body 20. Thus, it is possible to increase the density of the sintered body 50, thereby improving the properties of the sintered body 50.

In contrast, if the amount of the powder 1 is smaller than the lower limit value noted above, the green body 20 exhibits inferior formability. If the amount of the powder 1 exceeds the upper limit value noted above, it becomes difficult to sufficiently increase the density of the sintered body 50, which may possibly impair the properties of the sintered body 50.

The powder 1 may be produced by any method. In the case where the powder 1 is constituted of the metallic material, it can be produced by: various kinds of atomizing methods such as a liquid atomizing method including a water atomizing method (e.g., an atomizing method using a fast-spinning water stream or a spinning-liquid atomizing method) and a gas atomizing method; a pulverizing method; a carbonyl method; a chemical method such as a reduction method; and so forth.

2. Binder

The binder 2 is a component greatly affecting the formability (ease of shaping) of the composition 10 in the below-described step of producing the green body 20 and the shape stability (shape retention) of the green body 20 and a brown body (debound body). Inclusion of such the binder 2 in the composition 10 makes it possible to easily and reliably produce the sintered body 50 with the increased dimensional accuracy.

In the present invention, the binder 2 includes a first resin 3 that can be decomposed by ozone.

The first resin 3 has a nature of being decomposed when making contact with ozone. Therefore, in a first debinding the green body 20 (first debinding step) described later, the first resin 3 of this nature contained in the green body 20 is decomposed at a relatively low temperature by making contact with ozone, which decomposition proceeds from the surface side of the green body 20 toward the inside thereof.

In other words, the first resin 3 is decomposed into gaseous components (decomposed first resin 3) having a low molecular weight. The decomposed first resin 3 generated in such a decomposition process is quickly removed from the green body 20. Thus, the green body 20 goes through the first debinding step.

By debinding the green body 20 in this manner, it is possible to prevent the binder 2 contained in the green body 20 from rapidly softening at a high temperature in a debinding step, which would otherwise lead to deformation of the green body 20 as is the case in the prior art. It is also possible to reliably prevent the binder 2 vaporized within the green body 20 from being suddenly discharged to the outside, which would otherwise cause deformation or cracking of the green body 20.

As noted above, the present invention ensures that the first resin 3 is decomposed and the decomposed first resin 3 is easily and quickly removed from the green body 20. In other words, it is possible to easily and quickly debind the green body 20.

This makes it possible to shorten the time required in carrying out the whole debinding the green body 20 (debinding step), while maintaining the shape retention of the brown body thus debound. As a result, it becomes possible to improve the production efficiency of the brown body and, eventually, the production efficiency of the sintered body 50.

The amount of the first resin 3 contained in the binder 2 is preferably 20 wt % or more, more preferably 30 wt % or more and even more preferably 40 wt % or more. If the amount of the first resin 3 falls within the above-noted range, it becomes possible to reliably provide the effect of decomposing the first resin 3 and removing the decomposed first resin 3. It is also possible to accelerate the debinding process of the binder 2 as a whole.

The first resin 3 is not particularly limited as long as it can be decomposed by ozone. Examples of the first resin 3 include polyether-based resins, aliphatic carbonic ester-based resins and polylactate-based resins, one or more of which may be used independently or in combination.

These resins are readily decomposed when making contact with ozone and exhibit relatively high wettability with respect to metal powder. This means that the metal powder is sufficiently dispersed even when a kneading operation is performed for a short period of time. Accordingly, the first resin 3 can be suitably used as a constituent material of the binder 2.

It is preferred that the first resin 3 is mainly constituted of at least one of the polyether-based resins and the aliphatic carbonic ester-based resins. These resins are very easily decomposed even at a relatively low temperature when making contact with ozone. The decomposed resins are discharged to the outside in the form of a gas. This makes it possible to quickly debind the green body 20.

The aliphatic carbonic ester-based resins exhibit very high wettability with respect to the metal powder. Therefore, it is possible to obtain a sufficiently homogeneously compound (composition 10) of the powder 1 and the aliphatic carbonic ester-based resins even when the kneading operation is performed for a short period of time.

Description will now be given on the polyether-based resins.

Examples of the polyether-based resins include: straight-chain polyether-based resins such as polyacetal-based resins and polyethylene oxide-based resins; and aromatic polyether-based resins such as polyether ketone-based resins, polyether ether-based resins, polyether nitrile-based resins, polyether sulfone-based resins and polythioether sulfone-based resins, one or more of which may be used independently or in combination.

It is preferred that the polyether-based resins are mainly constituted of the polyacetal-based resins (a polyacetal resin or its derivative) among the resins mentioned above. When exposed to an ozone-containing atmosphere, the polyacetal-based resins are decomposed into formaldehyde or the like and discharged from the green body 20.

The polyacetal-based resins exhibit very high decomposability, thus making it possible to reliably debind the green body 20 in the first debinding step described later. Therefore, use of the polyacetal-based resins makes it possible to shorten the time required in completing the whole debinding step.

The polyether-based resins have a weight-average molecular weight preferably in a range of about 10,000 to 300,000 and more preferably in a range of about 20,000 to 200,000. The polyether-based resins show an optimum melting point and an optimum viscosity in this range of molecular weight, thus helping to increase the shape stability (shape retention) of the green body 20.

Next, the aliphatic carbonic ester-based resins will be described in detail.

The aliphatic carbonic ester-based resins can be synthesized by reacting phosgene or its derivative with aliphatic diol in the presence of base.

The number of carbons in the portions of repeating units of the aliphatic carbonic ester-based resins excepting carbonic ester groups, i.e., the number of carbons existing between the carbonic ester groups in the aliphatic carbonic ester-based resins, i.e., the number of the carbon atoms contained in each of the repeating units other than carbon atoms of the carbonic ester group, is preferably 2 to 11, more preferably 3 to 9 and even more preferably 4 to 7.

In the case of the aliphatic carbonic ester-based resin represented by a general formulae $((CH_2)_m—O—CO—O)_n$, the number of carbons refers to "m". If the number of carbons falls within the above-noted range, the aliphatic carbonic ester-based resins become easily and quickly decomposable.

More specifically, it is preferred that the aliphatic carbonic ester-based resins are mainly constituted of alkane dial polycarbonate, such as ethane diol polycarbonate, propane diol polycarbonate, butane dial polycarbonate, hexane diol polycarbonate and decane diol polycarbonate, or its derivative.

The alkane dial polycarbonate exhibits very high decomposability, thus making it possible to reliably debind the green body 20 in the first debinding step described later. Therefore, use of the alkane dial polycarbonate makes it possible to shorten the time required in completing the whole debinding step.

In this regard, the aliphatic carbonic ester-based resins are decomposed when making contact with ozone. Then, the decomposed aliphatic carbonic ester-based resins thus generated are discharged to the outside of the green body 20 as a gas. Examples of the decomposed aliphatic carbonic ester-based resins include alkene oxide (e.g., ethylene oxide or propene oxide), a decomposed substance of alkene oxide, water vapor and carbon dioxide.

It is preferred that the aliphatic carbonic ester-based resins have no unsaturated bond. This enables the aliphatic carbonic ester-based resins to be easily decomposed when making contact with ozone. As a result, it becomes possible to efficiently decompose the aliphatic carbonic ester-based resins and remove the decomposed aliphatic carbonic ester-based resins.

The aliphatic carbonic ester-based resins have a weight-average molecular weight preferably in a range of about 10,000 to 300,000 and more preferably in a range of about 20,000 to 200,000. The aliphatic carbonic ester-based resins show an optimum melting point (softening point) and an optimum viscosity in this range of molecular weight, thus helping to increase the shape stability (shape retention) of the green body 20.

In the meantime, the polylactate-based resins are polyester that can be obtained through ring-opening polymerization of lactide which is a cyclic dimer of lactic acid.

The polylactate-based resins may be of any kind as long as they can be decomposed by ozone. Examples of the polylactate-based resins include: lactic acid polymer resins (lactic acid homopolymers) such as a poly-L-lactic acid resin, a poly-D-lactic acid resin and a poly-L/D-lactic acid resin; and copolymer resins of lactic acid and aliphatic hydroxycarboxylic acid such as glycolic acid and hydroxybutylcarboxylic acid, aliphatic lactone such as glycolide, butyrolactone and caprolactone, aliphatic diol such as ethylene glycol, propylene glycol, butane diol and hexane diol, polyalkylene ether such as polyethylene glycol, polypropylene glycol, polybutylene ether, diethylene glycol, triethylene glycol and ethylene/propylene glycol, aliphatic polycarbonate such as polybutylene carbonate, polyhexane carbonate and polyoctane carbonate, or aliphatic dicarboxylic acid such as succinic acid, adipic acid, azelaic acid, sebacic acid and decane dicarboxylic acid. One or more of these resins may be used independently or in combination.

The polylactate-based resins have a weight-average molecular weight preferably in a range of about 10,000 to 300,000 and more preferably in a range of about 20,000 to 200,000.

In this embodiment, the binder 2 further includes a second resin 4 which thermal decomposition temperature is higher than a melting point of the first resin 3.

The decomposition of the second resin 4 and removal of the decomposed second resin 4 occur by heating the green body 20 in a second debinding the intermediate brown body (second debinding step) performed later than a first debinding step. Inclusion of such the second resin 4 contained in the binder 2 ensures that the first resin 3 and the second resin 4 contained in the green body 20 are decomposed in different temperature regions of the debinding step.

In other words, the debinding step is divided into the first debinding step and the second debinding step performed later than the first debinding step. This makes it possible to selectively decompose the first resin 3 and the second resin 4 contained in the green body 20, and to remove (or debind) the decomposed first resin 3 and the decomposed second resin 4 one after another. As a result, it becomes possible to control the debinding progress of the green body 20, whereby the sintered body 50 having the improved shape retention, i.e., dimensional accuracy, can be produced in an easy and reliable manner.

Although not particularly limited, the second resin 4 have a weight-average molecular weight preferably in a range of about 1,000 to 400,000 and more preferably in a range of about 4,000 to 300,000. The second resin 4 shows an optimum melting point and an optimum viscosity in this range of molecular weight, thus helping to further increase the shape stability (shape retention) of the green body 20.

The second resin 4 may be of any kind as long as it has a thermal decomposition temperature higher than the melting point of the first resin 3 contained in the binder 2.

Examples of the second resin 4 include, but are not particularly limited thereto: polyolefin-based resins such as polyethylene, polypropylene and ethylene vinyl acetate copolymer; polystyrene-based resins; polyvinyl-based resins such as polyvinyl alcohol, polyvinyl acetal and polyvinyl acetate; acrylic resins such as polymethylmethacrylate and polybutylmethacrylate; polyamide-based resins such as nylon; polyester-based resins such as polyethylene terephthalate and polybutylene terephthalate; and copolymers of these resins. One or more of the resins and the copolymers may be used independently or in mixture.

It is preferred that the second resin 4 is mainly constituted of at least one of polystyrene and polyolefin among the resins noted above. These resins exhibit increased bonding strength in the brown body obtained, thereby reliably preventing deformation of the brown body obtained.

Furthermore, these resins exhibit high flowability and are easily decomposed when heated. This makes it easy to debind the green body 20, as a result of which it becomes possible to produce, with increased reliability, the brown body having improved dimensional accuracy.

The binder 2 is not limited to a particular form but may take any form including, e.g., a powder form, a liquid form and a gel form.

The amount of the binder 2 in the composition 10 is not particularly limited but may be preferably about 2 to 40 wt % and more preferably about 5 to 30 wt %. If the amount of the binder 2 falls within the above-noted range, it becomes possible to form the green body 20 with increased formability and also to increase the density of the green body 20. This allows the green body 20 to have greatly improved stability in shape.

The composition 10 may contain an additive. It is preferred that the additive is decomposable together with the second resin 4 and the decomposed second resin 4 and the decomposed additive are removable in the second debinding step described later. This allows the binder 2 to fulfill the function offered by the additive.

Furthermore, this makes it possible to decompose the additive and remove the decomposed additive without adversely affecting the shape retention and the dimensional accuracy of the brown body.

In this regard, examples of the additive include a dispersant (lubricant) 5, a plasticizer and an antioxidant, one or more of which may be used independently or in combination. Addition of these additives enables the composition 10 to fulfill various functions provided by the respective additives.

Among these additives, the dispersant 5 adheres to a periphery of each of the powder 1 as illustrated in FIG. 2 and serves to increase dispersibility of the particles of the powder 1 in the composition 10. In other words, inclusion of the dispersant 5 in the composition 10 ensures that the particles of the powder 1 are uniformly dispersed in the first resin 3 and the second resin 4. As a result, the brown body and the sintered body 50 obtained exhibit little variation in their properties and show increased uniformity.

The dispersant 5 also functions as a lubricant. In other words, the dispersant 5 has a function of increasing flowability of the composition 10 in the green body forming step described later. This makes it possible to fill the composition 10 into a forming mold with an increased filling ability and, consequently, to obtain the green body 20 of uniform density.

Examples of the dispersant 5 include: anionic organic dispersants such as higher fatty acid, which includes stearic acid, distearic acid, tristearic acid, linolenic acid, octanoic acid, oleic acid, palmitic acid and naphthenic acid, polyacrylic acid, polymethacrylic acid, polymaleic acid, acrylic acid-maleic acid copolymer and polystyrene sulfonic acid; cationic organic dispersants such as quaternized ammonium salt; nonionic organic dispersants such as polyvinyl alcohol, carboxymethylcellulose and polyethylene glycol; and inorganic dispersants such as tricalcium phosphate.

It is preferred that the dispersant 5 is mainly constituted of the higher fatty acid among these dispersants. The higher fatty acid is capable of greatly increasing dispersibility of the powder 1.

The carbon atoms of the higher fatty acid are preferably 16 to 30 and more preferably 16 to 24. If the carbon atoms of the higher fatty acid fall within the above-noted range, it becomes possible to avoid reduction in formability of the composition 10, which in turn increases the shape retention of the green body 20 and the brown body.

Furthermore, if the carbon atoms of the higher fatty acid fall within the above-noted range, the higher fatty acid becomes easily decomposable even at a relatively low temperature, thereby improving the production efficiency of the brown body and the sintered body 50.

The plasticizer, one of the additives, has a function of giving flexibility to the composition 10 and facilitating formation of the green body 20 in the forming the green body 20 (green body forming step) described later.

Examples of the plasticizer include phthalic acid ester (e.g., dioctyl phthalate (DOP), diethyl phthalate (DEP) and dibutyl phthalate (DBP)), adipic acid ester, trimellitic acid ester and sebacic acid ester.

The antioxidant, one of the additives, has a function of preventing oxidation of the resins (first resin 3 and second resin 4) that constitutes the binder 2. Examples of the antioxidant include hindered phenol-based antioxidants and hydrazine-based antioxidants.

The composition 10 containing the components noted above can be prepared by mixing the respective components with the powder 1. The task of mixing the respective components and the powder 1 may be performed in any atmosphere.

Preferably, the mixing task is carried out under a vacuum pressure or reduced pressure (of e.g., 3 kPa or less) and in a non-oxidizing atmosphere, e.g., in an atmosphere of an inert gas such as a nitrogen gas, an argon gas or a helium gas. This makes it possible to prevent oxidization of the metallic material included in the composition 10.

If needed, a kneading operation may be performed after the mixing process to increase volume density of the composition 10 and also to assure improved composition uniformity. This makes it possible to obtain the green body 20 with high density and increased uniformity, consequently increasing the dimensional accuracy of the brown body and the sintered body 50.

The kneading operation of the composition 10 can be performed using a variety of kneading machines such as a pressure kneader type kneading machine, a double arm kneader type kneading machine, a roller type kneading machine, a Banbury type kneading machine, a single-shaft extruding machine and a double-shaft extruding machine.

Among these kneading machines, it is particularly preferably to use the pressure kneader type kneading machine. The pressure kneader type kneading machine is capable of applying a strong shear force to the composition 10, thereby making it possible to reliably increase viscosity of the composition 10 obtained.

Kneading conditions vary with various conditions such as the composition or particle size of the powder 1, the composition of the binder 2 and the blending quantity of the powder 1 and the binder 2. Taking an example of the kneading conditions, the kneading temperature may be about 50 to 200° C. and the kneading time may be about 15 to 210 minutes. Furthermore, the kneading operation may be performed in any atmosphere.

Just like the mixing operation for preparation of the composition 10, it is preferred that the kneading operation be carried out under a vacuum pressure or reduced pressure (of e.g., 3 kPa or less) and in a non-oxidizing atmosphere, e.g., in an atmosphere of an inert gas such as a nitrogen gas, an argon gas or a helium gas. As mentioned earlier, this makes it possible to prevent oxidization of the metallic material included in the composition 10 reliably.

If necessary, a kneaded product (compound) obtained by the kneading operation is pulverized into pellets (small masses) having a diameter of, e.g., about 1 to 10 mm. Pelletization of the compound can be performed by means of a pulverizing device such as a pelletizer or the like.

Production of Sintered Body

Next, a method for producing a sintered body by use of the composition 10 (the method for producing the sintered body the present invention) will be described with reference to the process diagram illustrated in FIG. 1.

First Embodiment

First, a first embodiment of a method for producing a sintered body in accordance with the present invention will be described.

Figure 3:
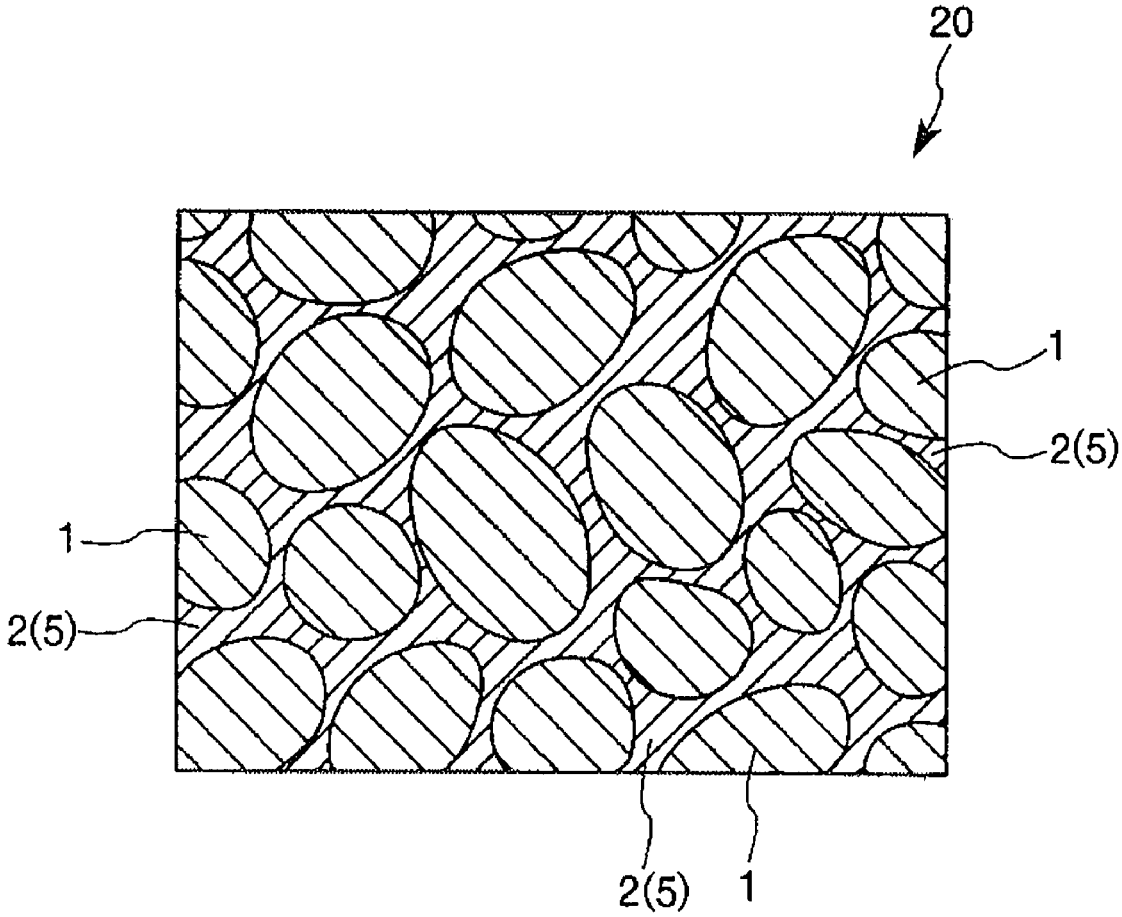
FIG. 3 is a vertical section view schematically showing a green body obtained in a first embodiment of a method for producing a sintered body in accordance with the present invention.
Figure 4:
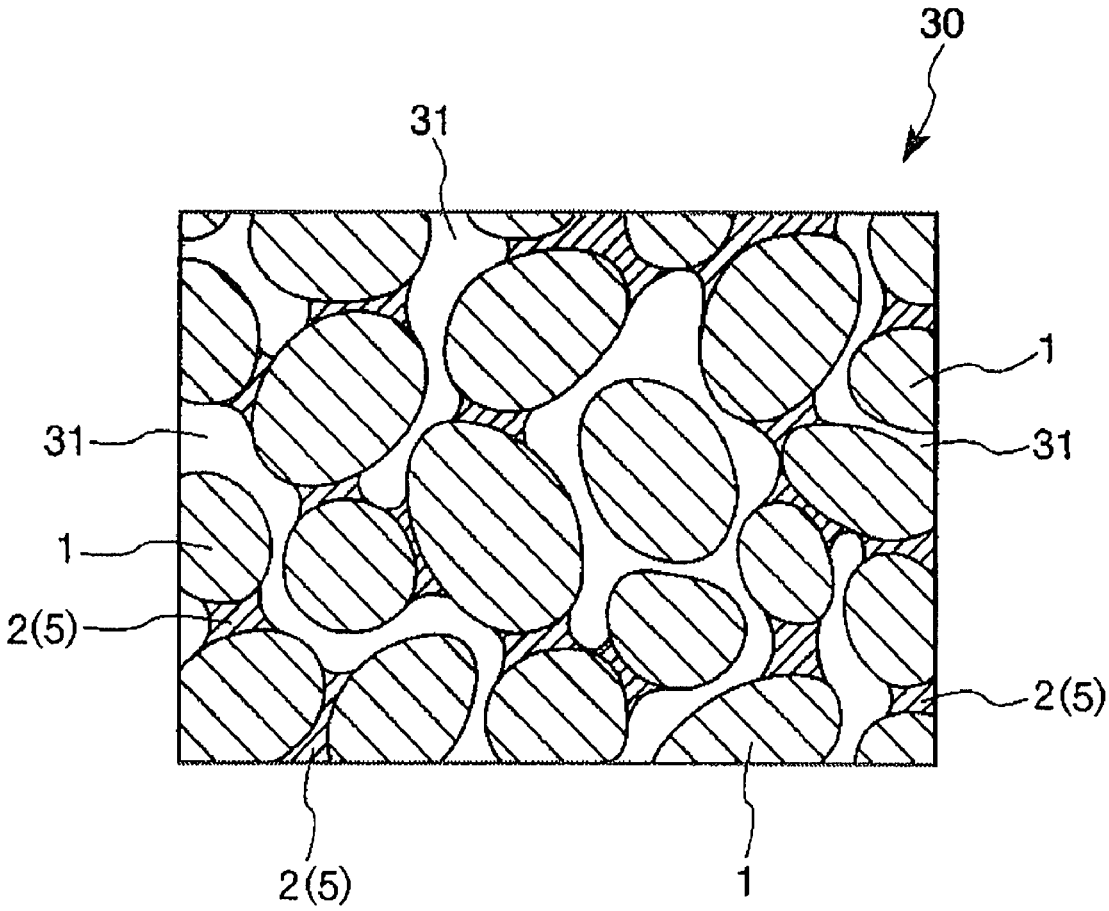
FIG. 4 is a vertical section view schematically showing a first brown body obtained in a first embodiment of a method for producing a sintered body in accordance with the present invention.
Figure 5:
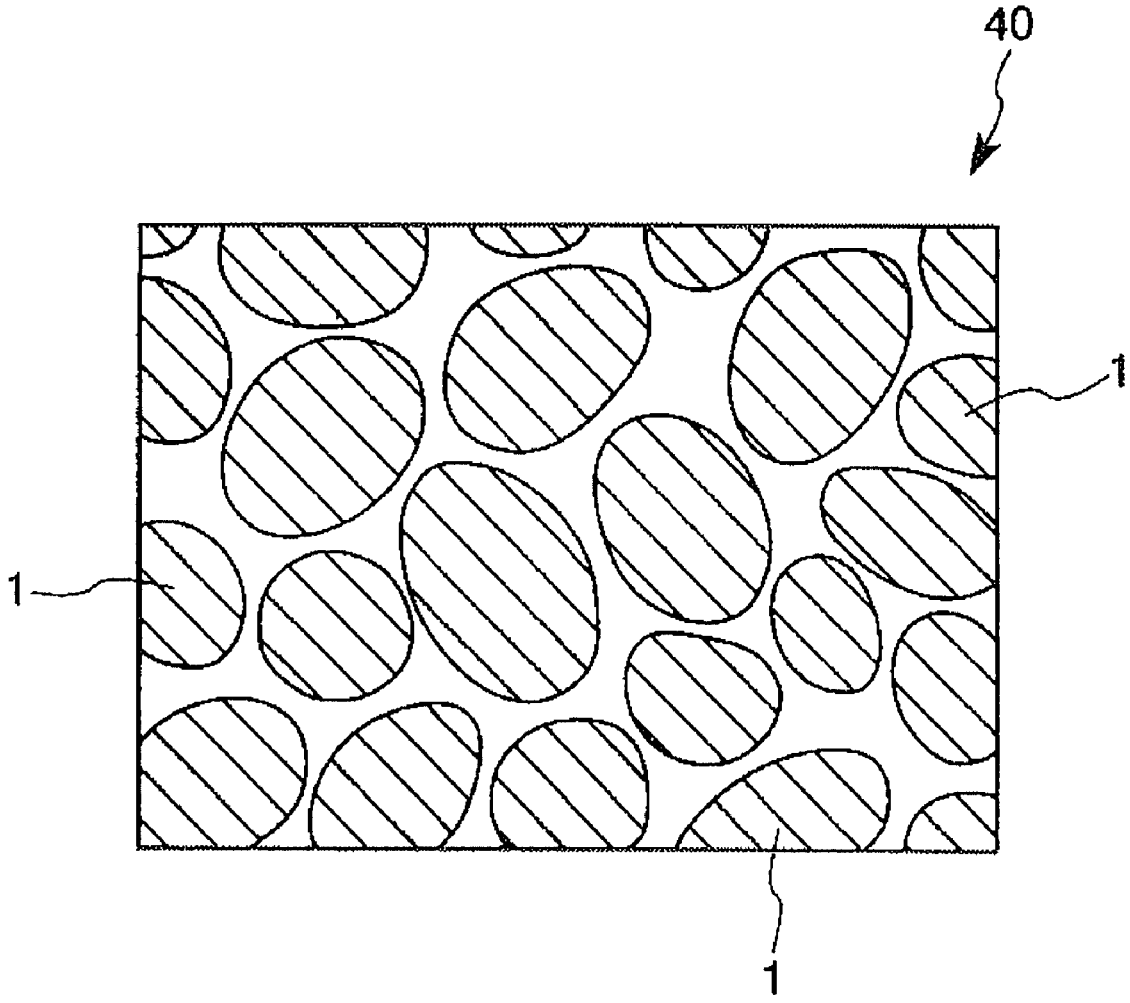
FIG. 5 is a vertical section view schematically showing a second brown body obtained in a first embodiment of a method for producing a sintered body in accordance with the present invention.
Figure 6:
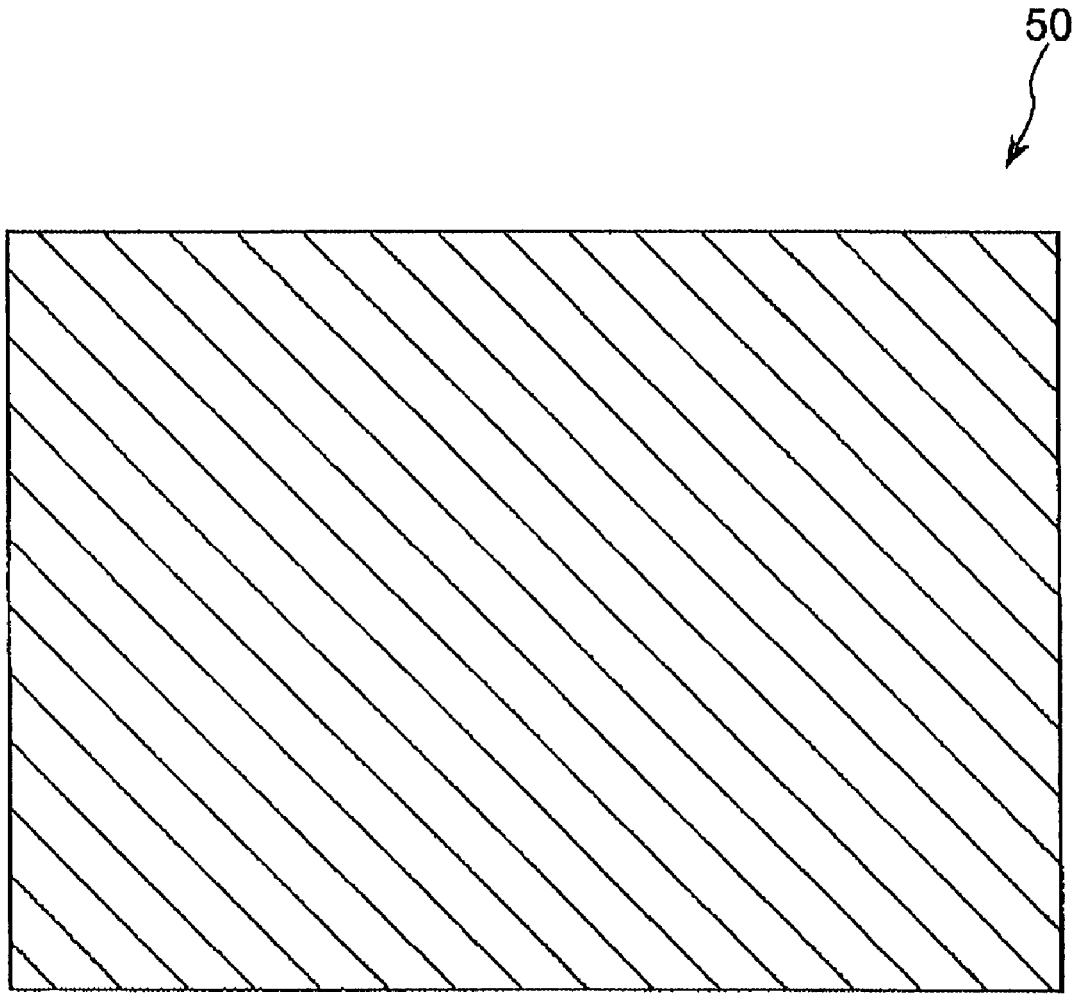
FIG. 6 is a vertical section view schematically illustrating a sintered body in accordance with the present invention.
Figure 7:
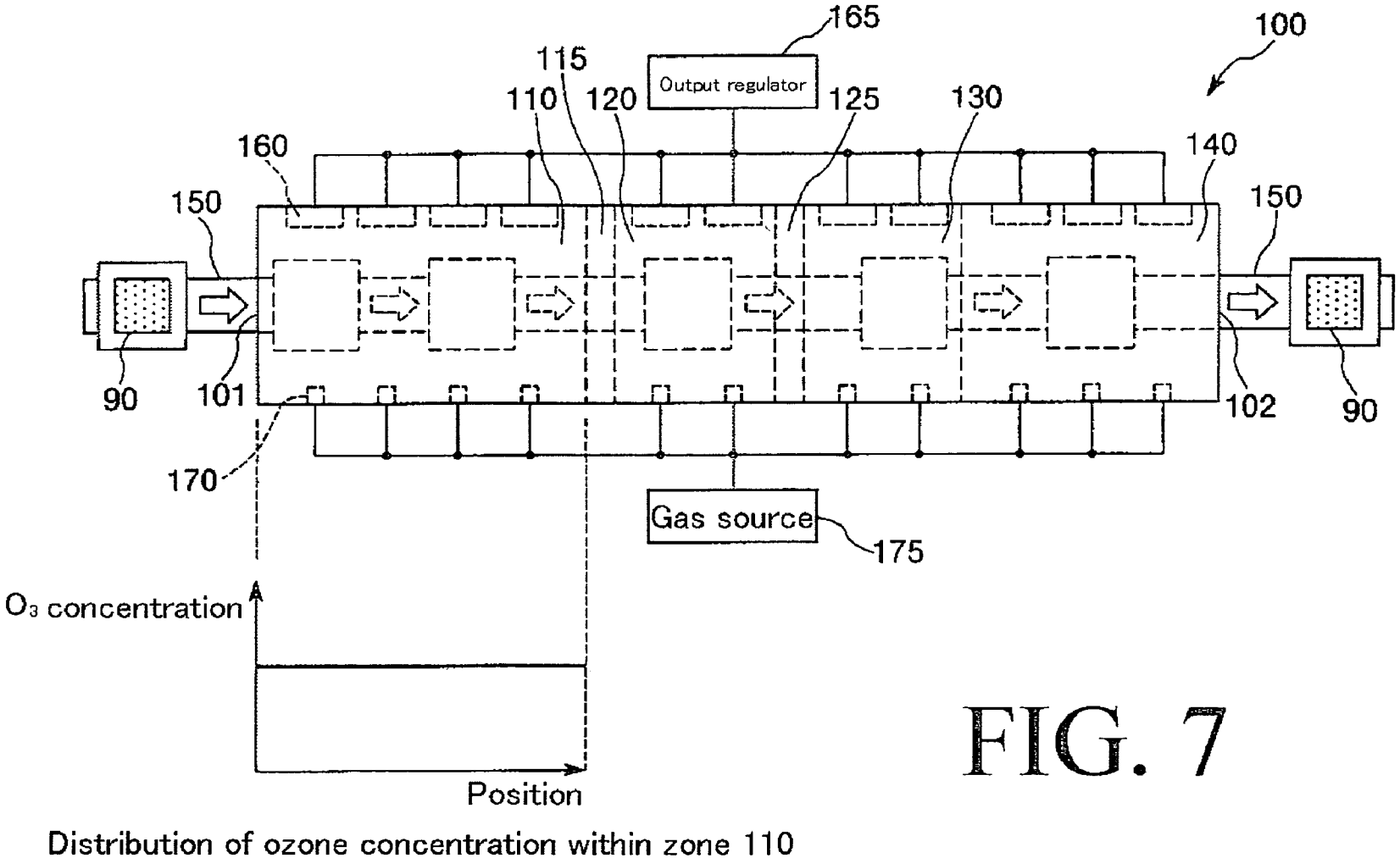
FIG. 7 is a plan view illustrating a continuous furnace utilized in a first embodiment of a method for producing a sintered body in accordance with the present invention.

FIG. 3 is a vertical section view schematically showing a green body obtained in the first embodiment of a method for producing a sintered body in accordance with the present invention. FIG. 4 is a vertical section view schematically showing a first brown body obtained in the first embodiment of a method for producing a sintered body in accordance with the present invention. FIG. 5 is a vertical section view schematically showing a second brown body obtained in the first embodiment of a method for producing a sintered body in accordance with the present invention. FIG. 6 is a vertical section view schematically illustrating a sintered body in accordance with the present invention. FIG. 7 is a plan view illustrating a continuous furnace utilized in the first embodiment of a method for producing a sintered body in accordance with the present invention.

The method for producing the sintered body shown in FIG. 1 includes: [A] forming a green body by molding the composition 10 into a specified shape to obtain the green body (green body forming step); [B] first debinding the green body by exposing the green body to a high ozone content atmosphere to decompose the first resin 3 and remove the decomposed first resin 3 form the green body to obtain a brown body (first debinding step); [C] exposing the thus obtained brown body at least once to a low ozone content atmosphere whose ozone concentration is lower than an ozone concentration of the high ozone content atmosphere to obtain an intermediate brown body (exposing step); and [D] second debinding the intermediate brown body which has been exposed to the low ozone content atmosphere by heating the intermediate brown body to decompose the second resin 4 and remove the decomposed second resin 4 from the intermediate brown body to obtain a second brown body (second debinding step); and [E] sintering the intermediate brown body which has been exposed to the low ozone content atmosphere to obtain the sintered body (sintering step).

Prior to describing the method for producing the sintered body, description will be made on a furnace for use in debinding and sintering a green body, which is shown in FIG. 7.

Any type of furnace may be used in the method for producing the sintered body 50 of the present invention. For example, use can be made of a continuous debinding and sintering furnace or a batch type debinding and sintering furnace. In the present embodiment, use of a continuous debinding and sintering furnace (hereinbelow abbreviated to a "continuous furnace") 100 will be described by way of example.

The continuous furnace 100 shown in FIG. 7 includes four internal zones (spaces) 110, 120, 130 and 140 communicating with one another. A conveyor 150 for conveying a workpiece 90 such as the green body 20, the first brown body 30, the intermediate brown body, the second brown body 40 or the sintered body 50 is continuously arranged within the zones 110, 120, 130 and 140.

In other words, the continuous furnace 100 is able to continuously perform the first debinding step [B], the exposing step [C], the second debinding step [D] and the sintering step [E] by allowing the workpiece 90 to pass through the respective zones 110, 120, 130 and 140 one after another. The workpiece 90 can be introduced into the furnace 100 through an inlet opening 101 by use of the conveyor 150.

The workpiece 90 thus introduced moves through the zones 110, 120, 130 and 140 one after another. Then, the workpiece 90 can be taken out from the furnace 100 through an outlet opening 102. This makes it possible to continuously process a plurality of workpieces 90 into sintered bodies 50, thereby increasing the sintered body production efficiency.

The continuous furnace 100 is also designed to prevent the workpiece 90 from being exposed to the air throughout the process of producing the sintered body 50. Thus, the continuous furnace 100 is able to reliably prevent oxidization of the metallic material contained in the workpiece 90, which would otherwise occur in case of the workpiece 90 making contact with the air.

Heaters 160 for heating the workpiece 90 to a predetermined temperature within the respective zones 110, 120, 130 and 140 are independently provided in each of the zones 110, 120, 130 and 140 along a longitudinal direction of the continuous furnace 100.

The heaters 160 are connected to an output regulator 165 for regulating the output of the respective heaters 160. The output regulator 165 is adapted to collaboratively control the output of the respective heaters 160, thereby crating a temperature gradient of specified pattern in the respective zones 110, 120, 130 and 140.

Also provided in the respective zones 110, 120, 130 and 140 are nozzles 170 for supplying a specified gas into each of the zones 110, 120, 130 and 140. The nozzles 170 are arranged in a longitudinal direction of the continuous furnace 100. The respective nozzles 170 are connected to a gas source 175 through pipelines and are adapted to supply different kinds of gases generated in the gas source 175 into the respective zones 110, 120, 130 and 140 at a predetermined flow rate.

In the present embodiment, the concentration of ozone is kept substantially constant within the zone 110 as illustrated by a graph in FIG. 7.

Provided in a gap between the zones 110 and 120 and a gap between the zones 120 and 130 are evacuation devices 115 and 125 for discharging gases from the gaps to the outside. Use of the evacuation devices 115 and 125 makes it possible to prevent the gases existing in the zones 110 and 120 or in the zones 120 and 130 from being mixed with each other.

In other words, it is possible to prevent gas components in the respective zones 110, 120, 130 and 140 from being changed unintentionally. Although the continuous furnace 100 shown in FIG. 7 has a rectilinear configuration when seen in a plan view, it may be curved in an intermediate portion thereof.

Hereinafter, the respective steps shown in FIG. 1 will be described one after another.

A. Green Body Forming Step

First, a compound obtained by kneading the composition 10 or pellets produced from the compound is formed into a specified shape, consequently obtaining the green body 20 as illustrated in FIG. 3.

The task of forming the green body 20 can be performed by various kinds of forming methods, e.g., an injection molding method, an extrusion molding method, a compression molding method (press molding method) or a calendar molding method. The molding pressure is preferably about 5 to 100 MPa in case the green body 20 is formed by the compression molding method.

Among the various kinds of forming methods, the injection molding method or the extrusion molding method is preferably used to form the green body 20.

The injection molding method is performed by injection-molding the compound or pellets for forming the green body 20 of desired shape and size by use of an injection molding machine. In case of using the injection molding method, it is possible to easily form the green body 20 having a complex and fine shape by suitably selecting a mold.

The execution conditions of the injection molding method vary with various conditions such as the composition or particle size of the powder 1, the composition of the binder 2 and the blending quantity of the powder 1 and the binder 2. As an example, the temperature of materials (the compound or pellets) to be injection-molded is preferably about 80 to 210° C. and the injection pressure is preferably about 2 to 15 MPa (20 to 150 kgf/cm$^2$).

The extrusion molding method is performed by extrusion-molding the compound or pellets for forming the extruded product by use of the extrusion molding machine and cutting the extruded product for forming the green body 20 having a desired length. In case of using the extrusion molding method, it is possible to very easily and cost-effectively form a columnar or plate-like green body 20 having a desired extrusion surface shape by suitably selecting the mold.

The execution conditions of the extrusion molding method vary with various conditions such as the composition or particle size of the powder 1, the composition of the binder 2 and the blending quantity of the powder 1 and the binder 2. As an example, the temperature of materials (the compound or pellets) to be extrusion-molded is preferably about 80 to 200° C. and the extrusion pressure is preferably about 1 to 10 MPa (10 to 100 kgf/cm$^2$).

The shape and size of the green body 20 thus molded is determined by taking into account the shrinkage of the green body 20 that may occur in the subsequent steps, i.e., the respective debinding steps, the exposing step and the sintering step.

B. First Debinding Step

Next, the green body 20 obtained in the green body forming step is placed on the conveyer 150 of the continuous furnace 100. The conveyer 150 is then operated to convey the green body 20 to the zone 110. While passing through the zone 110, the green body 20 is exposed to a high ozone content atmosphere whose ozone concentration is greater than that in the atmosphere of the exposing step described later.

By doing so, the first resin 3 contained in the green body 20 is decomposed and the decomposed first resin 3 is removed from the green body 20, consequently producing a first brown body 30 as illustrated in FIG. 4.

As mentioned earlier, the first resin 3 is decomposed at a relatively low temperature when making contact with ozone. The decomposed first resin 3 exists in a gas phase and the decomposed first resin 3 is easily and quickly removed. In other words, the green body 20 is easily and quickly debound. On the other hand, the second resin 4 and the additive are decomposed later than the first resin 3.

Therefore, the second resin 4 is hardly decomposed during the decomposition process of the first resin 3, although it may possibly be decomposed in part. In other words, a part of the second resin 4 remains intact in the green body 20. This ensures that the first brown body 30 thus obtained continues to have the shape retention.

This also makes it possible to shorten the time required in completing the first debinding step in its entirety. Owing to the fact that ozone is not corrosive, corrosion is difficult to occur in the equipments for performing the first debinding step. Thus, the first debinding step that makes use of ozone provides an advantage in that the equipments can be maintained and managed in an easy and cost-effective manner.

The decomposed first resin 3 is discharged from the green body 20 to the outside. This leaves extremely small flow paths 31 in the first brown body 30 along the traces through which the decomposed first resin 3 have passed. In the second debinding step described later, these flow paths 31 can serve as passageways through which the decomposed second resin 4 and the decomposed additive are discharged to the outside of the green body 20.

The flow paths 31 are formed when the first resin 3 makes contact with ozone and undergoes decomposition. Thus, the flow paths 31 are formed successively from the outer surface of the green body 20 toward the interior thereof, which means that the flow paths 31 are inevitably in communication with the external space. As a result, the flow paths 31 assist in reliably discharging the decomposed second resin 4 and the decomposed additive to the outside in the second debinding step described later.

As mentioned earlier, the high ozone content atmosphere utilized in the present step means an atmosphere in which the concentration of ozone is greater than that in the low ozone content atmosphere of the exposing step set forth later. In addition to ozone, the high ozone content atmosphere may further contain, e.g., oxidizing gases such as air and oxygen, inert gases such as nitrogen, helium and argon, or mixed gases consisting of one or more of these gases.

Among other things, an atmosphere containing inert gases in addition to ozone is preferable and an atmosphere containing inert gases mainly constituted of nitrogen is more preferable for use as the high ozone content atmosphere. Inert gases are difficult to react with a constituent material of the powder 1.

Thus, the inert gases prevent alteration or degradation of the powder 1 which would otherwise arise from an unintentional chemical reaction. Nitrogen is relatively cheap and therefore helps to make the first debinding step cost-effective.

The ozone concentration in the high ozone content atmosphere is preferably about 50 to 10,000 ppm, more preferably about 80 to 8,000 ppm and even more preferably about 100 to 5,000 ppm. If the ozone concentration falls within the above-noted range, it becomes possible to efficiently and reliably decompose the first resin 3 and remove the decomposed first resin 3. The decomposition efficiency of the first resin 3 is no longer increased even if the ozone concentration is raised above the upper limit value noted above.

In the first debinding step, it is preferred that the green body 20 is debound while freshly supplying a high ozone content gas to around the green body 20 and discharging the decomposed first resin 3 from the green body 20.

This ensures that the concentration of the decomposed first resin 3, i.e., decomposed gases, discharged from the green body 20 with the progress of debinding is increased around the green body 20. As a result, it becomes possible to avoid any inferior in the efficiency with which the first resin 3 is decomposed by ozone.

At this time, the flow rate of the high ozone content gas supplied is suitably set depending on the volume of the zone 110. Although not particularly limited, the flow rate of the high ozone content gas is preferably about 1 to 30 $m^3$/h and more preferably about 3 to 20 $m^3$/h.

The temperature of the high ozone content atmosphere varies such as the composition of the first resin 3, which the temperature is preferably about 20 to 190° C. and more preferably about 40 to 170° C. If the temperature of the high ozone content atmosphere falls within the above-noted range, it becomes possible to decompose the first resin 3 and to remove the decomposed first resin 3 in an easier and quicker manner.

This also makes it possible to avoid notable softening of the second resin 4 and, consequently, to prevent reduction in the shape retention of the first brown body 30. As a result, it is possible to reliably prevent reduction in the dimensional accuracy of the sintered body 50 finally obtained.

In the case where the first resin 3 is constituted of a polyether-based resin among others, the temperature of the high ozone content atmosphere is preferably about 20 to 180° C. and more preferably about 40 to 160° C.

In the case where the first resin 3 is constituted of an aliphatic carbonate ester-based resin among others, the temperature of the high ozone content atmosphere is preferably about 50 to 190° C. and more preferably about 70 to 170° C.

The debinding time in the first debinding step is not particularly limited but may be suitably set depending on the amount of the first resin 3 and the temperature of the high ozone content atmosphere. The debinding time is preferably about 1 to 30 hours and more preferably about 3 to 20 hours. This makes it possible to decompose the first resin 3 and remove the decomposed first resin 3 in an efficient and reliable manner.

Since the particles of the first brown body 30 thus obtained are bonded to the second resin 4, the first brown body 30 thus obtained exhibits toughness as a whole but the hardness thereof is not as great as that of the sintered body 50. Therefore, the first brown body 30 allows a variety of machining to be performed with ease.

C. Exposing Step

Next, the first brown body 30 obtained in the first debinding step is conveyed to the zone 120 by means of the conveyer 150. While passing through the zone 120, the first brown body 30 is exposed to a low ozone content atmosphere whose ozone concentration is smaller than that in the high ozone content atmosphere.

In this regard, a high ozone content gas with an increased ozone concentration remains in the flow paths 31 of the first brown body 30 obtained in the first debinding step. Ozone ($O_3$) has three oxygen atoms and is turned to an oxygen molecule ($O_2$) when one of the oxygen atoms is given to other materials. In other words, ozone is a highly reactive oxidizing substance.

Accordingly, there is a fear that the high concentration ozone remaining in the flow paths 31 may severely oxidize the metallic material contained in the first brown body 30. Particularly, in case the first brown body 30 is subjected to the second debinding step or the sintering step with the high concentration ozone remaining in the flow paths 31, the oxidizing action occurs markedly by the heat applied in the second debinding step or the sintering step.

Oxidization of the metallic material leaves metal oxide in the sintered body 50 finally obtained. This may possibly deteriorate the properties (e.g., mechanical, electrical and chemical properties) of the sintered body 50. More specifically, there is a fear that the metal oxide may reduce toughness or electric conductivity of the sintered body 50.

This is the reason why the exposing step of exposing the first brown body 30 to the low ozone content atmosphere is employed in the method for producing the brown body of the present embodiment.

In the exposing step, the high ozone content gas remaining in the flow paths 31 is substituted by a low ozone content gas (or an ozone-free gas). This reduces the frequency at which the metallic material contained in the first brown body 30 makes contact with ozone. As a result, it becomes possible to suppress oxidization of the metallic material and to reduce the quantity of metal oxide remaining in the sintered body 50. This also makes it possible to obtain the sintered body 50 having particularly high mechanical strength (toughness or the like).

By suppressing inclusion of the metal oxide which may act as a foreign material in the sintering step, it is possible to improve sinterability and to obtain the sintered body 50 of dense structure.

In this regard, the ozone concentration in the low ozone content atmosphere is preferably kept as low as possible, although there will be no problem if the ozone concentration in the low ozone content atmosphere is smaller than that in the high ozone content atmosphere.

More specifically, the ozone concentration in the low ozone content atmosphere varies with the ozone concentration in the high ozone content atmosphere and is preferably 500 ppm or less and more preferably 50 ppm or less. This makes it possible to reliably suppress oxidization of the metallic material contained in the first brown body 30.

It is preferred that substantially no ozone is included in the low ozone content atmosphere. This makes it possible to keep the flow paths 31 substantially free from ozone, thereby reliably preventing oxidization of the metallic material. Thus, metal oxide is kept from remaining in the sintered body 50 finally obtained, whereby the sintered body 50 produced exhibits particularly high mechanical strength (toughness or the like).

In addition to ozone, the low ozone content atmosphere may further contain, e.g., reducing gases such as hydrogen or inert gases such as nitrogen, helium and argon. Moreover, the low ozone content atmosphere may further contain mixed gases constituted of one or more of these gases. Preferably, the mixed gases are mainly constituted of a non-oxidizing gas. This makes it possible to quite reliably suppress oxidization of the metallic material in the present step.

At this time, the flow rate of the low ozone content gas supplied to the zone 120 is not particularly limited but may be suitably set depending on the volume of the zone 120. More specifically, the flow rate of the low ozone content gas is preferably about 0.5 to 30 $m^3$/h and more preferably about 1 to 20 $m^3$ /h.

It is preferred that the temperature of the low ozone content atmosphere be lower than that of the high ozone content atmosphere employed in the first debinding step. This makes it possible to reduce the oxidizing action exercised by the ozone of the low ozone content atmosphere existing in the flow paths 31, thereby suppressing oxidization of the metallic material contained in the first brown body 30.

More specifically, the temperature of the low ozone content atmosphere depends on that of the high ozone content atmosphere and is preferably about 5 to 180° C. and more preferably about 10 to 120° C. This makes it possible to reliably suppress the oxidizing action exercised by the ozone in the low ozone content atmosphere. It is also possible to prevent the first brown body 30 from undergoing a rapid temperature change.

It is preferred that the time for which the first brown body 30 is exposed to the low ozone content atmosphere is set as long as possible. The exposure time is preferably about 0.1 to 5 hours and more preferably about 0.5 to 3 hours. This ensures that the high concentration ozone remaining in the flow paths 31 is substituted by the low ozone content gas to a necessary and sufficient extent.

In the manner as set forth above, an intermediate brown body is obtained in which the high ozone content gas existing in the flow paths 31 of the first brown body 30 has been substituted by the low ozone content gas.

D. Second Debinding Step

Next, the intermediate brown body obtained in the exposing step is conveyed to the zone 130 by means of the conveyer 150. While passing through the zone 130, the intermediate brown body is heated to decompose the second resin 4 and the additive (e.g., dispersant 5) contained in the intermediate brown body and to remove the decomposed second resin 4 and the decomposed additive, consequently obtaining a second brown body 40 as illustrated in FIG. 5.

The second resin 4 (and the additive) thermally decomposed is discharged to the outside of the intermediate brown body through the flow paths 31 formed in the first debinding step. As a result, the intermediate brown body is debound easily and quickly. In other words, the second brown body 40 is obtained in an easy and quick manner.

By doing so, it becomes possible to prevent the second resin 4 and the additive from remaining within the second brown body 40 in a large quantity. That is to say, inasmuch as the decomposed second resin 4 and the decomposed additive are discharged to the outside of the intermediate brown body through the flow paths 31, they are inhibited from being entrapped within the intermediate brown body.

This makes it possible to reliably prevent occurrence of deformation or cracks in the second brown body 40 thus obtained. This also makes it possible to shorten the time required in the debinding steps as a whole. As a result, it is possible to obtain the second brown body 40 and the sintered body 50 that achieve improvement in their properties such as the dimensional accuracy, the mechanical strength and the like.

The flow paths 31 of the intermediate brown body disappear or survive as extremely fine pores during the sintering step. This ensures that the sintered body 50 obtained has particularly high density. In addition, this greatly reduces the possibility that problems such as marred aesthetic appearance and reduced mechanical strength are posed in the sintered body 50.

The atmosphere in which the present step (second debinding step) is performed is not particularly limited. Examples of the atmosphere include an atmosphere of a reducing gas such as hydrogen or the like, an atmosphere of an inert gas such as nitrogen, helium or argon and a reduced pressure (vacuum) atmosphere.

It is particularly preferred that the atmosphere for performing the present step be a reducing gas atmosphere mainly constituted of the reducing gas. Despite the fact that the present step is carried out at a relatively high temperature, it is possible to reliably prevent oxidization of the metallic material contained in the intermediate brown body if the reducing gas atmosphere mainly constituted of the reducing gas is used. It is also possible to decompose the second resin 4 and the additive and to remove the decomposed second resin 4 and the decomposed additive.

The temperature of the atmosphere for performing the present step may be set higher than the temperature of the atmosphere employed in the first debinding step. Depending on the composition of the second resin 4 and the additive, the atmospheric temperature in the present step is preferably about 180 to 600° C. and more preferably about 250 to 550° C.

If the atmospheric temperature falls within the above-noted range, it becomes possible to decompose the second resin 4 and the additive and to remove the decomposed second resin 4 and the decomposed additive in an efficient and reliable manner.

In contrast, if the atmospheric temperature is below the lower limit value noted above, there is a fear that the efficiency of decomposing the second resin 4 and the additive and removing the decomposed second resin 4 and the decomposed additive is lowered. Even if the atmospheric temperature is set greater than the upper limit value noted above, the decomposition speed of the second resin 4 and the additive is scarcely increased.

The debinding time in the second debinding step is not particularly limited and may be arbitrarily set depending on the composition and amount of the second resin 4 and the additive, the atmospheric temperature and so forth. More specifically, the debinding time is preferably about 0.5 to 10 hours and more preferably about 1 to 5 hours. This makes it possible to decompose the second resin 4 and the additive and to remove (or debind) the decomposed second resin 4 and the decomposed additive in an efficient and reliable manner.

The present step may be performed only when such a need exists. For instance, the present step may be omitted if neither the second resin 4 nor the additive is included in the composition 10. In this case, it is possible to obtain the brown body by way of the first debinding step and the exposing step.

E. Sintering Step

Next, the second brown body 40 obtained in the second debinding step is conveyed to the zone 140 by means of the conveyer 150. Then, the second brown body 40 is heated while allowing it to pass through the zone 140.

As the second brown body 40 is heated, the particles of the powder 1 in the second brown body 40 are mutually diffused in the interfaces of the adjoining particles of the powder 1. Thus, each particles of the powder 1 grows into crystal grains, consequently producing the sintered body 50 that has a dense structure as a whole. That is to say, the sintered body 50 having high density and low porosity is obtained as illustrated in FIG. 6.

The sintering temperature in the sintering step varies slightly depending on the composition of a constituent material of the powder 1. For example, the sintering temperature is preferably about 900 to 1,600° C. and more preferably about 1,000 to 1,500° C.

If the sintering temperature falls within the above-noted range, it becomes possible to optimize diffusion and grain growth of the particle of the powder 1. As a result, it is possible to obtain the sintered body 50 exhibiting improved properties (mechanical strength, dimensional accuracy, external appearance, etc.).

Furthermore, the sintering temperature in the sintering step may be changed (raised or lowered) over time within or outside the above-noted range. The sintering time is preferably about 0.5 to 7 hours and more preferably about 1 to 4 hours.

The sintering atmosphere is not particularly limited and may be arbitrarily selected depending on the composition of the metallic material of which the powder 1 are constituted.

Examples of the sintering atmosphere include an atmosphere of a reducing gas such as hydrogen or the like, an atmosphere of an inert gas such as nitrogen, helium or argon, a reduced pressure atmosphere created by reducing the pressure of these gas atmospheres and an increased pressure atmosphere created by increasing the pressure of these gas atmospheres.

It is preferred that the sintering atmosphere is the reducing gas atmosphere among others. Use of the reducing gas atmosphere makes it possible to perform the sintering step without oxidizing the metallic material included in the second brown body 40. This also eliminates the need to use an evacuation pump or the like for creating a reduced pressure atmosphere, which helps to reduce the running costs required in performing the sintering step.

In case of the reduced pressure atmosphere, the pressure is not particularly limited but may be preferably 3 kPa (22.5 Torr) or less and more preferably 2 kPa (15 Torr) or less.

In case of the increased pressure atmosphere, the pressure is not particularly limited but may be preferably about 110 to 1,500 kPa and more preferably about 200 to 1,000 kPa.

The sintering atmosphere may be changed in the midst of the sintering step. For example, the reduced pressure atmosphere of about 3 kPa may be initially used and then replaced by the afore-mentioned inert gas atmosphere in the midst of the sintering step.

The sintering step may be performed by dividing the same into two or more subordinate steps. This makes it possible to improve the sintering efficiency of the second brown body 40 (powder 1) and to perform the sintering step within a shortened period of time.

It is preferred that the sintering step is performed soon after the second debinding step set forth above. This allows the second debinding step to serve as a pre-sintering step. As a result, it becomes possible to preheat the second brown body 40, thereby sintering the second brown body 40 (powder 1) in a more reliable manner.

In the manner as described above, the sintered body 50 with low metal oxide amount and improved properties can be produced safely, easily and cost-effectively.

Second Embodiment

Next, description will be made on a second embodiment of a method for producing a sintered body in accordance with the present invention.

Figure 8:
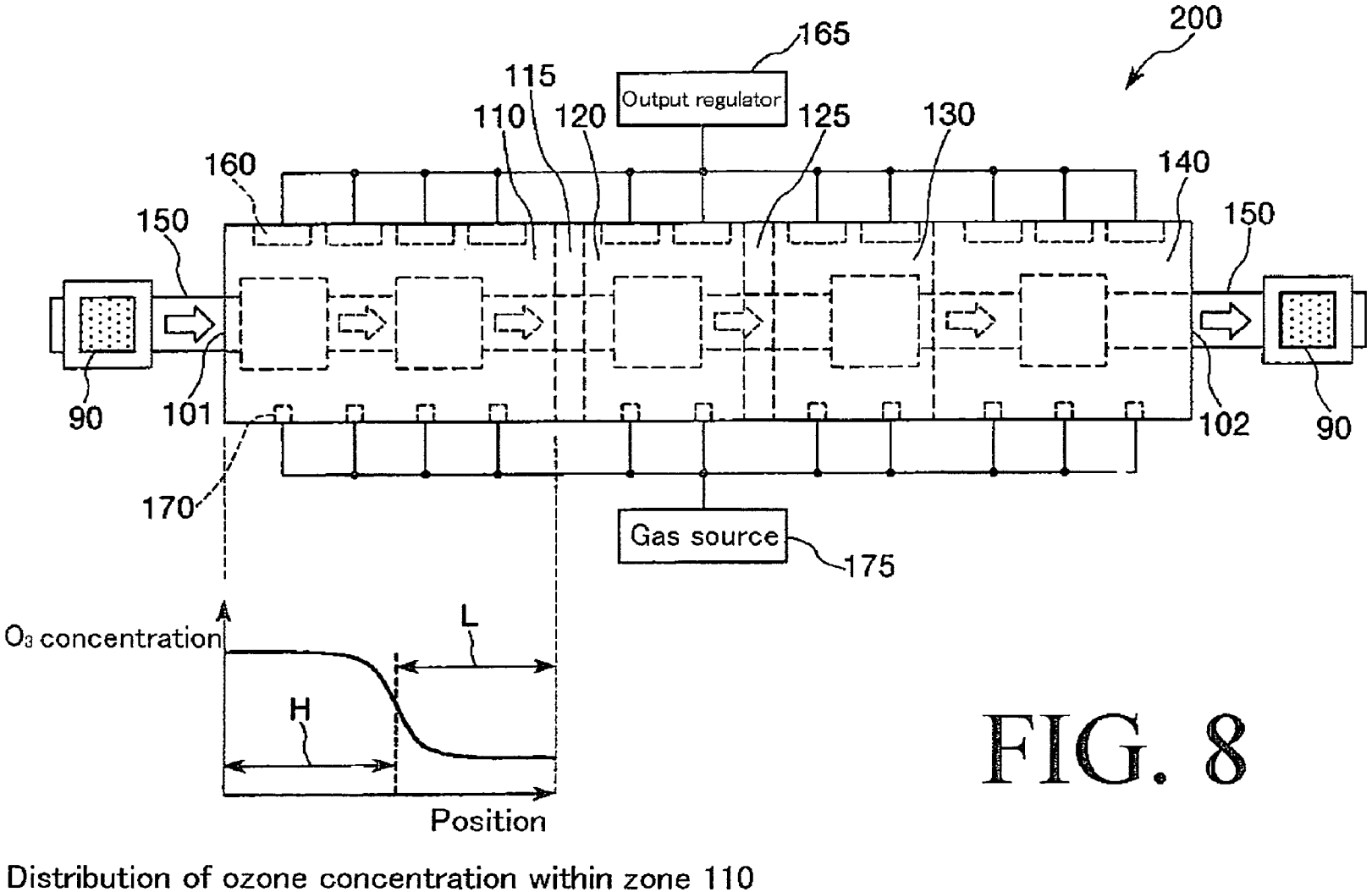
FIG. 8 is a plan view illustrating a continuous furnace utilized in a second embodiment of a method for producing a sintered body in accordance with the present invention.

FIG. 8 is a plan view illustrating a continuous furnace utilized in a second embodiment of a method for producing a sintered body in accordance with the present invention. The following description on the second embodiment will be centered on the points differing from the first embodiment. No description will be given on the same points.

The method for producing the sintered body of the present embodiment is the same as the method for producing the sintered body of the first embodiment, except that the ozone concentration in the high ozone content atmosphere created within a zone in a continuous furnace used is differently set.

In other words, the continuous furnace 200 shown in FIG. 8 is designed to ensure that the ozone concentration varies continuously along a moving direction of the workpiece 90 within the zone 110.

Additionally illustrated in FIG. 8 is a graph that represents the distribution of ozone ($O_3$) concentration within the zone 110. As can be seen from the graph, the ozone concentration within the zone 110 is decreased from a midway point of the zone 110 toward a downstream side in the moving direction of the workpiece 90.

In other words, the zone 110 is divided into a high ozone content atmosphere region H lying near an inlet opening of the furnace and having a relatively high ozone concentration and a low ozone content atmosphere region L lying near a zone 120 and having an ozone concentration lower than that of the high ozone content atmosphere region H.

In the case where the ozone concentration has a gradient within the zone 110 as noted above, the kind and flow rate of a gas supplied from the nozzles 170 corresponding to the region H may differ from the kind and flow rate of the gas fed from the nozzles 170 corresponding to the region L.

Next, the method for producing the sintered body of the present embodiment by use of the continuous furnace 200 set forth above will be described on a step-by-step basis.

A. Green Body Forming Step

First, the green body 20 as illustrated in FIG. 3 is obtained in the same manner as in the green body forming step described the first embodiment.

B. First Debinding Step

Next, the green body 20 obtained in the green body forming step is placed on a conveyer 150 of the continuous furnace 200 and is conveyed to the zone 110. While passing through the region H within the zone 110, the green body 20 is exposed to the high ozone content atmosphere, whereby the first resin 3 in the green body 20 can be decomposed and the decomposed first resin 3 can be removed as in the first debinding step described the first embodiment. This produces the first brown body 30 as illustrated in FIG. 4.

C 1. Exposing Step (First Stage)

Next, the first brown body 30 obtained in the first debinding step is conveyed to the region L within the zone 110 by means of the conveyer 150. While passing through the region L, the first brown body 30 is exposed to the low ozone content atmosphere (first stage), whereby the high ozone content gas remaining in the flow paths 31 of the first brown body 30 is substituted by the low ozone content gas as in the exposing step described the first embodiment.

C 2. Exposing Step (Second Stage)

Next, the first brown body 30 that has undergone the first stage of the exposing step is conveyed into the zone 120 by means of the conveyer 150. While passing through the zone 120, the first brown body 30 is exposed to an atmosphere containing substantially no ozone (second stage) whereby the ozone remaining in the flow paths 31 of the first brown body 30 can be removed for the most part. This produces the intermediate brown body.

D. Second Debinding Step

Next, the intermediate brown body obtained in the second stage of the exposing step is conveyed into the zone 130 by means of the conveyer 150. The intermediate brown body is heated as it passes through a zone 130, whereby the second resin 4 and the additive (e.g., dispersant 5) in the intermediate brown body can be decomposed and the decomposed second resin 4 and the decomposed additive can be removed as in the second debinding step described the first embodiment. This produces the second brown body 40 as illustrated in FIG. 5.

E. Sintering Step

Next, the second brown body 40 obtained in the second debinding step is conveyed into a zone 140 by means of the conveyer 150. The second brown body 40 is then heated as it passes through the zone 140, whereby the second brown body 40 is sintered as in the sintering step described the first embodiment. This produces the sintered body 50 as illustrated in FIG. 6.

With the present embodiment, the first debinding step and the first exposing step are continuously performed within a single zone, i.e., the zone 110. This allows the atmosphere within the zone 110 to be continuously changed from the high ozone content atmosphere to the low ozone content atmosphere.

At this time, the first resin 3 in the green body 20 exposed to the high ozone content atmosphere is decomposed and the decomposed first resin 3 is removed. Thus, the particles of the metal powder 1 kept covered with the first resin 3 come into view little by little. The particles of the metal powder 1 thus bared are gradually exposed to ozone.

In the present embodiment, the continuous furnace 200 is designed to ensure that the atmosphere within the zone 110 is changed from the high ozone content atmosphere to the low ozone content atmosphere. This further reduces the frequency with which the bared particles of the metal powder 1 are exposed to ozone. As a result, it becomes possible to effectively suppress oxidization of the metallic material of which the powder 1 is formed.

Furthermore, it is possible to perform the first debinding step and the first stage of the exposing step within a shortened period of time by allowing them to be continuously carried out within the single zone, i.e., the zone 110.

In addition, it is possible to more reliably remove the ozone remaining in the flow paths 31 of the first brown body 30 by performing the exposing step at two times.

The method for producing the sintered body 50 of the second embodiment by use of the continuous furnace 200 provides the same operations and effects as those that are available in the method for producing the sintered body 50 by use of the continuous furnace 100.

Third Embodiment

Next, description will be made on a third embodiment of a method for producing a sintered body in accordance with the present invention.

Figure 9:
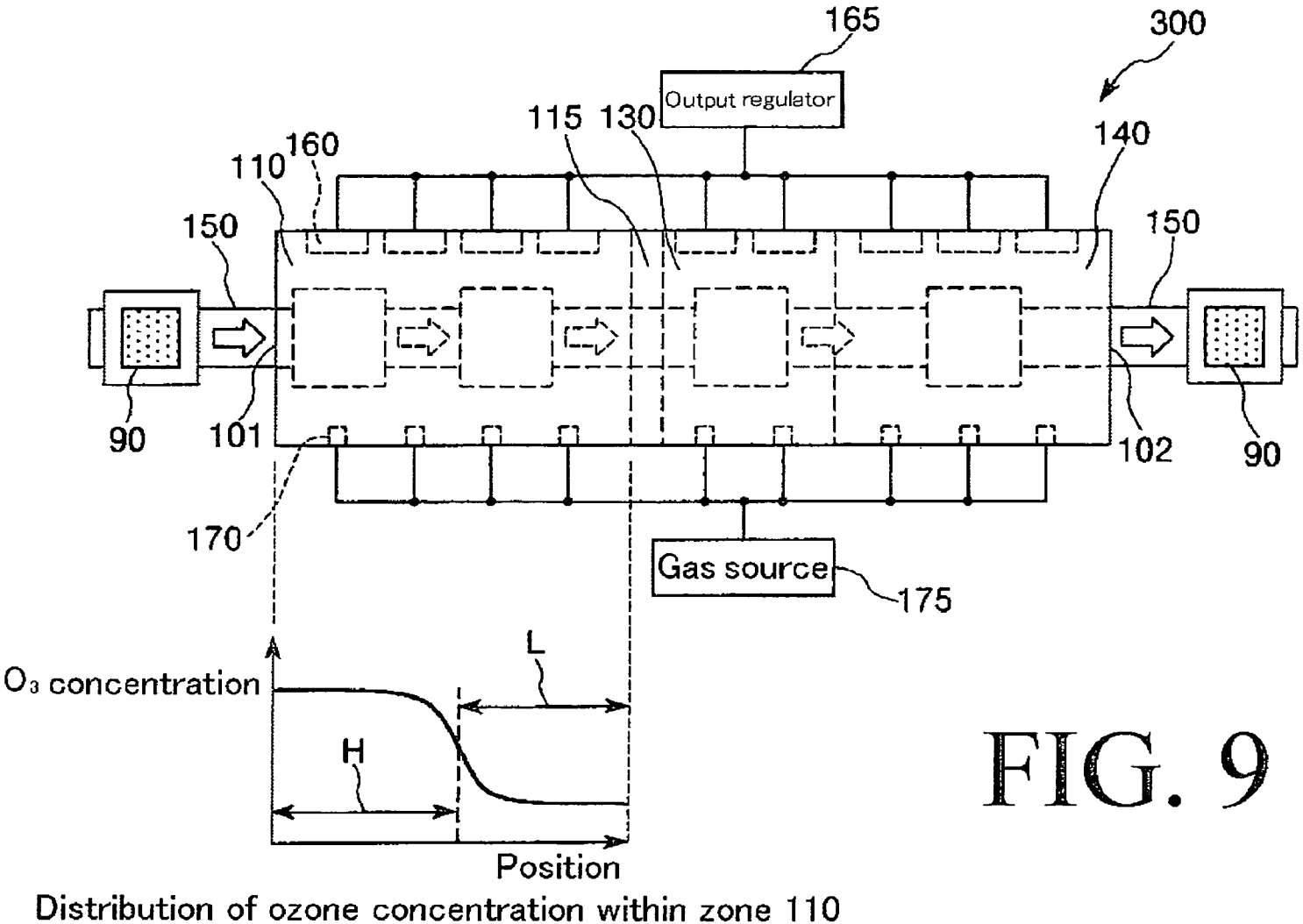
FIG. 9 is a plan view illustrating a continuous furnace utilized in a third embodiment of a method for producing a sintered body in accordance with the present invention.

FIG. 9 is a plan view illustrating a continuous furnace utilized in a third embodiment of a method for producing a sintered body in accordance with the present invention. The following description on the third embodiment will be centered on the points differing from the first embodiment and the second embodiment. No description will be given on the same points.

The method for producing the sintered body of the present embodiment is the same as the method for producing the sintered body of second embodiment, except for differences in configuration of a used continuous furnace.

Referring to FIG. 9, the continuous furnace 300 has three internal zones (spaces) 110, 130 and 140 communicating with one another.

That is to say, the continuous furnace 300 shown in FIG. 9 is a furnace fabricated by eliminating the zone 120 from the respective zones 110, 120, 130 and 140 of the continuous furnace 200 illustrated in FIG. 8.

As with the continuous furnaces 100 and 200, a conveyer 150 is arranged within the respective zones 110, 130 and 140 of the continuous furnace 300. Just like the continuous furnaces 100 and 200, a plurality of heaters 160 and a plurality of nozzles 170 are independently provided in each of the zones 110, 130 and 140. The heaters 160 are associated with an output regulator 165 and the nozzles 170 are connected to a gas source 175.

In the present embodiment employing the continuous furnace 300, the ozone concentration within the zone 110 varies along a moving direction of the workpiece 90 as is the case in the zone 110 shown in FIG. 8. Additionally illustrated in FIG. 9 is a graph that represents the distribution of ozone ($O_3$) concentration within the zone 110.

As can be seen from the graph, the ozone concentration within the zone 110 is decreased from a midway point of the zone 110 toward a downstream side in the moving direction of the workpiece 90 as is the case in the zone 110 shown in FIG. 8. In other words, the zone 110 is divided into a high ozone content atmosphere region H and a low ozone content atmosphere region L.

Next, the method for producing the sintered body of the present embodiment by use of the continuous furnace 300 set forth above will be described on a step-by-step basis.

A. Green Body Forming Step

First, the green body 20 as illustrated in FIG. 3 is obtained in the same manner as in the green body forming step described in the first embodiment and the second embodiment.

B. First Debinding Step

Next, the green body 20 obtained in the green body forming step is placed on a conveyer 150 of the continuous furnace 300 and is conveyed to the zone 110. While passing through the region H within the zone 110, the green body 20 is exposed to a high ozone content atmosphere, whereby the first resin 3 in the green body 20 can be decomposed and the decomposed first resin 3 can be removed in the same manner as described in the first embodiment and the second embodiment. This produces the first brown body 30 as illustrated in FIG. 4.

C. Exposing Step

Next, the first brown body 30 obtained in the first debinding step is conveyed to the region L within the zone 110 by means of the conveyer 150. While passing through the region L, the first brown body 30 is exposed to the low ozone content atmosphere, whereby the high ozone content gas remaining in the flow paths 31 of the first brown body 30 can be substituted by the low ozone content gas as in the exposing step described in the first embodiment and the second embodiment. This produces the intermediate brown body.

D. Second Debinding Step

Next, the intermediate brown body obtained in the exposing step is conveyed into the zone 130 by means of the conveyer 150. The intermediate brown body is heated as it passes through the zone 130, whereby the second resin 4 and the additive (e.g., dispersant 5) in the intermediate brown body can be decomposed and the decomposed second resin 4 and the decomposed additive can be removed as in the second debinding step described in the first embodiment and the second embodiment. This produces the second brown body 40 as illustrated in FIG. 5.

E. Sintering Step

Next, the second brown body 40 obtained in the second debinding step is conveyed into the zone 140 by means of the conveyer 150. The second brown body 40 is then heated as it passes through the zone 140, whereby the second brown body 40 is sintered as in the sintering step described in the first embodiment and the second embodiment. This produces the sintered body 50 as illustrated in FIG. 6.

The method for producing the sintered body 50 by use of the continuous furnace 300 provides the same operations and effects as are available in the methods for producing the sintered body 50 by use of the continuous furnaces 100 of the first embodiment and the continuous furnaces 200 of the second embodiment.

While certain preferred embodiments of the method for producing the sintered body and the sintered body have been described hereinabove, the present invention is not limited thereto.

If necessary, a method for producing a sintered body may include optional steps.

EXAMPLES

Next, actual experimental examples of the present invention will be described in detail.

In Case Where First Resin is Polyether-Based Resin

1. Preparation of Green Body

Specified number of (two hundred) green bodies was prepared for each of Sample Numbers set forth below.

Sample No. 1

SUS316L powder produced by a water atomizing method and polyacetal resin (having a weight-average molecular weight of 50,000) were mixed with each other and kneaded to obtain a compound, by use of a pressure kneader (kneading machine) under the following kneading conditions: a kneading temperature of 190° C.; a kneading time of 1.5 hours; and an atmosphere of nitrogen gas.

The SUS316L powder used had an average particle size of 10 μm. The mixing ratio of the SUS316L powder and other components (the binder and the additive) was 91:9 by weight.

Then, the compound was pulverized into pellets having an average particle size of 3 mm. Green bodies of Sample No. 1 were obtained by repeatedly injection-molding the pellets with an injection molding machine under the following molding conditions: a material (pellets) temperature of 200° C.; and an injection pressure of 10.8 MPa (110 kgf/cm$^2$).

The green bodies were formed of a cubic shape having a size of 15×15×15 mm. Each of the green bodies had a through-hole formed by the injection molding machine. The through-hole was formed to penetrate the center portions of two opposite surfaces of each of the green bodies. The through-hole had an inner diameter of 5 mm.

Sample Nos. 2 to 10

Green bodies of Sample Nos. 2 to 10 were prepared in the same manner as applied to preparation of the green bodies of Sample No. 1, except that the mixing ratio of the components other than the SUS316L powder (i.e., the binder and the additive) and the composition of the binder were changed as shown in Table 1.

Sample Nos. 11 and 12

Green bodies of Sample Nos. 11 and 12 were prepared in the same manner as applied to preparation of the green bodies of Sample No. 1, except that the mixing ratio of the components other than the SUS316L powder (i.e., the binder and the additive) and the composition of the binder were changed as shown in Table 1.

TABLE 1

| | | Mixing Ratio (Weight Ratio) of Metal Powder and Components Other than Metal Powder Components | | Composition and Mixing Ratio (Weight Ratio) of Components other than Metal Powder | | | | |
|---|---|---|---|---|---|---|---|---|
| | | | | Binder | | | | |
| | | | | First Resin (Polyether-based Resin) | | | | |
| | Composition | | Other than | | Polyether | Second Rsesin | | |
| Sample No. | of Metal Powder | Metal Powder | Metal Powder | Polyacetal (Mw:50,000) | Oxide (Mw:50,000) | Polystylene (Mw:10,000) | Polyethylene (Mw:300,000) | Additive Stearic Acid |
| 1 | SUS316L | 91 | 9 | 100 | — | — | — | — |
| 2 | SUS316L | 91 | 9 | — | 100 | — | — | — |
| 3 | SUS316L | 91 | 9 | 75 | 25 | — | — | — |
| 4 | SUS316L | 91 | 9 | 90 | — | 10 | — | — |
| 5 | SUS316L | 91 | 9 | 90 | — | — | 10 | — |
| 6 | SUS316L | 91 | 9 | 90 | — | 5 | 5 | — |
| 7 | SUS316L | 91 | 9 | 90 | — | 9 | — | 1 |
| 8 | SUS316L | 91 | 9 | 50 | — | 50 | — | — |
| 9 | SUS316L | 91 | 9 | 20 | — | 75 | — | 5 |
| 10 | SUS316L | 91 | 9 | 15 | — | 80 | — | 5 |
| 11 | SUS316L | 91 | 9 | — | — | 95 | — | 5 |
| 12 | SUS316L | 91 | 9 | — | — | 50 | 50 | — |

2. Production of Sintered Body

Example 1

First brown bodies were obtained by debinding the green bodies of Sample No. 1 (in a first debinding step) under the following conditions: a temperature of 150° C.; a time period of 20 hours; and an atmosphere of ozone-containing nitrogen gas (with an ozone concentration of 20 ppm).

Intermediate brown bodies were then obtained by exposing the first brown bodies to a nitrogen gas (in an exposing step) under the following conditions: a temperature of 100° C.; a time period of 1 hour; and an atmosphere of nitrogen gas.

The continuous furnace as illustrated in FIG. 7 was used in the first debinding step and the exposing step. Subsequently, sintered bodies were obtained by sintering the intermediate brown bodies with the continuous furnace as illustrated in FIG. 7 under the following conditions: a temperature of 1,350° C.; a time period of 3 hours; and an atmosphere of hydrogen gas.

Examples 2 to 13

Sintered bodies were obtained in the same manner as in Example 1, except that the sample numbers of the green bodies, the conditions of the first debinding step and the conditions of the exposing step were respectively changed as shown in Table 2.

Example 14

The first brown bodies were obtained by exposing the green bodies of Sample No. 4 to an ozone-containing nitrogen gas (in a first debinding step) in the same manner as in Example 4. The intermediate brown bodies were obtained by exposing the first brown bodies thus obtained to a nitrogen gas (in an exposing step) in the same manner as in Example 4. Then, second brown bodies were obtained by exposing the intermediate brown bodies to a hydrogen gas (in a second debinding step) under the following conditions: a temperature of 500° C.; a time period of 1 hour; and an atmosphere of hydrogen gas. Sintered bodies were obtained by sintering the second brown bodies in the same manner as in Example 4.

Examples 15 to 20

Sintered bodies were obtained in the same manner as in Example 14, except that the sample numbers of the green bodies and the conditions of the second debinding step were respectively changed as shown in Table 2.

Example 21

Sintered bodies were obtained in the same manner as in Example 14, except that the continuous furnace shown in FIG. 8 was used and further that the concentration of ozone contained in the ozone-containing nitrogen gas within a first debinding zone of the continuous furnace was continuously decreased from 1,000 ppm to 50 ppm.

Example 22

Sintered bodies were obtained in the same manner as in Example 14, except that the continuous furnace shown in FIG. 9 was used and further that the concentration of ozone contained in the ozone-containing nitrogen gas within a first debinding zone of the continuous furnace was continuously decreased from 1,000 ppm to 50 ppm.

Comparative Example 1

Sintered bodies were obtained in the same manner as in Example 1, except that the ozone concentration was changed to 0 ppm.

Comparative Example 2

Sintered bodies were obtained in the same manner as in Example 1, except that the ozone concentration was changed to 0 ppm and further that the time period for the first debinding step was changed to 80 hours.

Comparative Example 3

Sintered bodies were obtained in the same manner as in Example 4, except that the exposing step was omitted.

Comparative Example 4

Sintered bodies were obtained in the same manner as in Example 8, except that the time period for the first debinding step was changed to 6 hours and further that the ozone concentration in the atmosphere of the exposing step was changed to 20,000 ppm.

Comparative Examples 5 and 6

Sintered bodies were obtained in the same manner as in Example 14, except that the sample numbers of the green bodies and the conditions of the second debinding step were respectively changed as shown in Table 2.

3. Evaluation 3-1. Evaluation of Weight Loss Percentage

First, the weight of the green bodies prepared in Examples 1 to 22 and Comparative Examples 1 to 6 was measured by an electronic weighing scale. Then, the weight of the first brown bodies of the Examples 1 to 22 and the Comparative Examples 1 to 6 obtained in the first debinding step was measured by the electronic weighing scale.

The weight loss quantity of the green bodies in the first debinding step was calculated based on the weight of the green bodies and the first brown bodies. The weight loss percentage of the green bodies in the first debinding step was found based on the weight loss quantity of the green bodies and the weight thereof.

Furthermore, the weight of the intermediate brown bodies obtained in Examples 14 to 22 and Comparative Examples 5 and 6 was measured by the electronic weighing scale. Then, the weight of the second brown bodies obtained in the second debinding step was measured by the electronic weighing scale.

The weight loss quantity of the intermediate brown bodies in the second debinding step was calculated based on the weight of the intermediate brown bodies and the second brown bodies. The weight loss percentage of the intermediate brown bodies in the second debinding step was found based on the weight loss quantity of the intermediate brown bodies and the weight thereof.

In respect of the respective Examples and the respective Comparative Examples, the weight loss percentage in the first debinding step and the weight loss percentage in the second debinding step were summed up, consequently calculating the weight loss percentage of the debinding steps as a whole.

In respect of the respective Examples and the respective Comparative Examples, the weight loss percentage of the debinding steps as a whole was divided by the ratio of the components other than the metal powder shown in Table 1, thereby calculating the removal percentage of the components other than the metal powder (the binder and the additive).

Moreover, the time required in the debinding steps as a whole was measured. The evaluation results are shown in Table 2.

TABLE 2

| | | Producing Conditions | | | | | | | | | | |
|---|---|---|---|---|---|---|---|---|---|---|---|---|
| | | First Debinding Step | | | | Exposing Step | | | | | | |
| | Sample No. | Temp. [° C.] | Time [hr] | Atmosphere | Ozone Concentration [ppm] | Temp. [° C.] | Time [hr] | Atmosphere | Ozone Concentration [ppm] | Second Debinding Step Temp [° C.] | Time [hr] | Atmosphere |
| Ex. 1 | 1 | 150 | 20 | $O_3/N_2$ | 20 | 100 | 1 | $N_2$ | 0 | — | — | — |
| Ex. 2 | 1 | 150 | 10 | $O_3/N_2$ | 50 | 100 | 1 | $N_2$ | 0 | — | — | — |
| Ex. 3 | 1 | 150 | 8 | $O_3/N_2$ | 300 | 100 | 1 | $N_2$ | 0 | — | — | — |
| Ex. 4 | 1 | 150 | 6 | $O_3/N_2$ | 1000 | 100 | 1 | $N_2$ | 0 | — | — | — |
| Ex. 5 | 1 | 150 | 5 | $O_3/N_2$ | 5000 | 100 | 1 | $N_2$ | 0 | — | — | — |
| Ex. 6 | 1 | 150 | 4 | $O_3/N_2$ | 8000 | 100 | 1 | $N_2$ | 0 | — | — | — |
| Ex. 7 | 1 | 150 | 4 | $O_3/N_2$ | 10000 | 100 | 1 | $N_2$ | 0 | — | — | — |
| Ex. 8 | 1 | 150 | 4 | $O_3/N_2$ | 10000 | 100 | 1 | $O_3/N_2$ | 50 | — | — | — |
| Ex. 9 | 1 | 150 | 4 | $O_3/N_2$ | 10000 | 150 | 1 | $O_3/N_2$ | 500 | — | — | — |
| Ex. 10 | 1 | 20 | 15 | $O_3/N_2$ | 1000 | 100 | 1 | $N_2$ | 0 | — | — | — |
| Ex. 11 | 1 | 180 | 4 | $O_3/N_2$ | 1000 | 100 | 1 | $N_2$ | 0 | — | — | — |
| Ex. 12 | 2 | 150 | 5 | $O_3/N_2$ | 5000 | 100 | 1 | $N_2$ | 0 | — | — | — |
| Ex. 13 | 3 | 150 | 5 | $O_3/N_2$ | 5000 | 100 | 1 | $N_2$ | 0 | — | — | — |
| Ex. 14 | 4 | 150 | 6 | $O_3/N_2$ | 1000 | 100 | 1 | $N_2$ | 0 | 500 | 1 | $H_2$ |
| Ex. 15 | 5 | 150 | 6 | $O_3/N_2$ | 1000 | 100 | 1 | $N_2$ | 0 | 500 | 1 | $H_2$ |
| Ex. 16 | 6 | 150 | 6 | $O_3/N_2$ | 1000 | 100 | 1 | $N_2$ | 0 | 500 | 1 | $H_2$ |
| Ex. 17 | 7 | 150 | 6 | $O_3/N_2$ | 1000 | 100 | 1 | $N_2$ | 0 | 500 | 1 | $H_2$ |
| Ex. 18 | 8 | 150 | 6 | $O_3/N_2$ | 1000 | 100 | 1 | $N_2$ | 0 | 500 | 1 | $H_2$ |
| Ex. 19 | 9 | 150 | 6 | $O_3/N_2$ | 1000 | 100 | 1 | $N_2$ | 0 | 500 | 2 | $H_2$ |
| Ex. 20 | 10 | 150 | 6 | $O_3/N_2$ | 1000 | 100 | 1 | $N_2$ | 0 | 500 | 2 | $H_2$ |
| Ex. 21 | 4 | 150 | 6 | $O_3/N_2$ | 1000→50 | 100 | 1 | $N_2$ | 0 | 500 | 1 | $H_2$ |
| Ex. 22 | 4 | 150 | 6 | $O_3/N_2$ | 1000→50 | — | — | — | — | 500 | 1 | $H_2$ |
| Com. Ex. 1 | 1 | 150 | 20 | $N_2$ | 0 | 100 | 1 | $N_2$ | 0 | — | — | — |
| Com. Ex. 2 | 1 | 150 | 80 | $N_2$ | 0 | 100 | 1 | $N_2$ | 0 | — | — | — |
| Com. Ex. 3 | 1 | 150 | 6 | $O_3/N_2$ | 1000 | — | — | — | — | — | — | — |
| Com. Ex. 4 | 1 | 150 | 6 | $O_3/N_2$ | 10000 | 100 | 1 | $O_3/N_2$ | 20000 | — | — | — |
| Com. Ex. 5 | 11 | 150 | 6 | $O_3/N_2$ | 1000 | 100 | 1 | $N_2$ | 0 | 500 | 5 | $H_2$ |
| Com. Ex. 6 | 12 | 150 | 6 | $O_3/N_2$ | 1000 | 100 | 1 | $N_2$ | 0 | 500 | 5 | $H_2$ |

| | Evaluation Results | | | | |
|---|---|---|---|---|---|
| | | | Debinding Steps as Whole | | |
| | Sample No. | First Debinding Step Weight Loss Percentage [wt %] | Second Debinding Step Weight Loss Percentage [wt %] | Weight Loss Percentage [wt %] | Removal Percentage of Components Other than Metal Powder [wt %] | Time Required [hr] |
| Ex. 1 | 1 | 8.70 | — | 8.70 | 96.7 | 21 |
| Ex. 2 | 1 | 8.81 | — | 8.81 | 97.9 | 11 |
| Ex. 3 | 1 | 8.90 | — | 8.90 | 98.9 | 9 |
| Ex. 4 | 1 | 8.91 | — | 8.91 | 99.0 | 7 |
| Ex. 5 | 1 | 8.93 | — | 8.93 | 99.2 | 6 |
| Ex. 6 | 1 | 8.90 | — | 8.90 | 98.9 | 5 |
| Ex. 7 | 1 | 8.90 | — | 8.90 | 98.9 | 5 |
| Ex. 8 | 1 | 8.94 | — | 8.94 | 99.3 | 5 |
| Ex. 9 | 1 | 8.95 | — | 8.95 | 99.4 | 5 |
| Ex. 10 | 1 | 8.66 | — | 8.66 | 96.2 | 16 |
| Ex. 11 | 1 | 8.93 | — | 8.93 | 99.2 | 5 |
| Ex. 12 | 2 | 8.92 | — | 8.92 | 99.1 | 6 |
| Ex. 13 | 3 | 8.85 | — | 8.85 | 98.3 | 6 |
| Ex. 14 | 4 | 8.01 | 0.94 | 8.95 | 99.4 | 8 |
| Ex. 15 | 5 | 7.98 | 0.94 | 8.92 | 99.1 | 8 |
| Ex. 16 | 6 | 8.02 | 0.93 | 8.95 | 99.4 | 8 |
| Ex. 17 | 7 | 8.00 | 0.91 | 8.91 | 99.0 | 8 |
| Ex. 18 | 8 | 4.45 | 4.48 | 8.93 | 99.2 | 8 |
| Ex. 19 | 9 | 1.78 | 7.01 | 8.79 | 97.7 | 9 |
| Ex. 20 | 10 | 1.33 | 7.40 | 8.73 | 97.0 | 9 |
| Ex. 21 | 4 | 8.05 | 0.93 | 8.98 | 99.8 | 8 |
| Ex. 22 | 4 | 8.01 | 0.92 | 8.93 | 99.2 | 7 |
| Com. Ex. 1 | 1 | 0.13 | — | 0.13 | 1.4 | 21 |

TABLE 2-continued

| | | | | | | |
|---|---|---|---|---|---|---|
| Com. Ex. 2 | 1 | 0.59 | — | 0.59 | 6.6 | 81 |
| Com. Ex. 3 | 1 | 8.88 | — | 8.88 | 98.7 | 6 |
| Com. Ex. 4 | 1 | 8.91 | — | 8.91 | 99.0 | 7 |
| Com. Ex. 5 | 11 | 0.24 | 7.34 | 7.58 | 84.2 | 12 |
| Com. Ex. 6 | 12 | 0.41 | 7.65 | 8.06 | 89.6 | 12 |

As is apparent from Table 2, 96% or more of the binder and the additive were removed in the debinding steps (first and second debinding steps) of the respective Examples. This means that debinding was performed in a reliable manner.

Furthermore, in the respective Examples, it was possible to shorten the time required in the debinding steps as a whole, although the shortened time varied slightly with the composition of the binder, the ozone concentration in the atmosphere of the first debinding step and the temperature of the atmosphere.

This is because the tasks of decomposing the poly ether-based resin and removing the decomposed poly ether-based resin were performed quickly in the first debinding step, eventually assuring quick decomposition of the second resin and rapid removal of the decomposed second resin.

In case of the green bodies whose binder contained the poly ether-based resin in a large percentage, the decomposition efficiency of the binder grew high, thereby greatly shortening the processing time.

Turning to the Comparative Examples, one half or more of the binder remained in the green bodies in case of Comparative Examples 1 and 2, despite the fact that debinding was performed for a long period of time. Thus, debinding occurred insufficiently.

This is because no ozone was contained in the atmosphere of the first debinding step and because polyether-based resin remained in the green bodies in a large quantity with no progress of decomposition of the polyether-based resin and removal of the decomposed polyether-based resin.

The green bodies used in Comparative Examples 5 and 6 did not contain the polyether-based resin. For this reason, the binder was not sufficiently decomposed in the first debinding step even at a low temperature of 150° C. Thus, debinding did not occur sufficiently even when the second debinding step was performed for a long period of time.

3-2 Evaluation of Density of Sintered Body

Density was measured for the sintered bodies obtained in the respective Examples and the respective Comparative Examples. The density measurement was conducted using Archimedes' principle (defined in JIS Z 2505). One hundred samples (sintered bodies) of each of the respective Examples and the respective Comparative Examples were subjected to the density measurement.

An average value of the density thus measured were calculated and shown in Table 3. Then, the relative density of the sintered bodies was calculated using the measured values. Calculation of the relative density was made on the basis of the density (theoretical density) of SUS316L, i.e., 7.98 g/cm$^3$.

3-3 Evaluation of Dimensional Accuracy of Sintered Body

Width (mm) was measured for one hundred sintered bodies of each of the respective Examples and the respective Comparative Examples. The width measurement was conducted using a micrometer. An average value was found based on the measured width for every one hundred sintered bodies. The difference between the average value and the width deviating greatest from the average value was referred to as a variation.

Then, circularity of center holes was measured for the sintered bodies obtained in the respective Examples and the respective Comparative Examples. The circularity measurement was conducted using a three-dimensional measuring instrument (made and sold by Mitsutoyo Corporation, Japan, under a model number FT805).

One hundred samples (sintered bodies) of each of the respective Examples and the respective Comparative Examples were subjected to the circularity measurement. An average value of the circularity for every one hundred measured values were calculated and shown in Table 3.

Measurement of density and size was omitted with respect to the sintered bodies of Comparative Example 1, because cracks were generated in almost all the one hundred sintered bodies.

3-4 Evaluation of Oxide Amount of Sintered Body

First, the sintered bodies obtained in the respective Examples and the respective Comparative Examples were cut to conduct the following analysis of oxygen amount and observation of the cut surfaces.

3-4-1. Oxygen amount of the respective sintered bodies was analyzed.

3-4-2. The cut surfaces of the respective sintered bodies were subjected to grinding and then observed by use of a scanning electron microscopy (SEM). As a result, it was confirmed that oxide particles exist in observation images of the cut surfaces.

Based on the analysis and observation conducted above, metal oxide amount in the respective sintered bodies was evaluated and identified by: "A" if the metal oxide amount was extremely small; "B" if the metal oxide amount was small; "C" if the metal oxide amount was a little great; and "D" if the metal oxide amount was extremely great.

3-5. Evaluation of Aesthetic Appearance of Sintered Body

Evaluation of aesthetic appearance was conducted for the (one hundred) sintered bodies obtained in the respective Examples and the respective Comparative Examples. Aesthetic appearance of the sintered bodies was observed with naked eyes.

The evaluation results of aesthetic appearance are identified by: "A" if none of the sintered bodies contained marks or cracks (including micro-cracks); "B" if a few sintered bodies contained marks or cracks (including micro-cracks); "C" if the majority of the sintered bodies contained marks or cracks (including micro-cracks); and "D" if almost all the sintered bodies contained cracks. The evaluation results of the above items 3-2 to 3-5 are shown in Table 3.

TABLE 3

| | | Conditions of Sintering Step | | | Evaluation Results of Sintered Body | | | | | |
|---|---|---|---|---|---|---|---|---|---|---|
| | | | | | Density | | Dimensional Accuracy | | | |
| | Sample No. | Temp. [° C.] | Time [hr] | Atmosphere | Measured Values [g/cm$^3$] | Relative Density [%] | Width (Variation) [mm] | Circularity [mm] | Oxide Amount | Aesthetic Appearance |
| Ex. 1 | 1 | 1350 | 3 | $H_2$ | 7.71 | 97 | 0.10 | 0.08 | A | A |
| Ex. 2 | 1 | 1350 | 3 | $H_2$ | 7.84 | 98 | 0.07 | 0.06 | A | A |
| Ex. 3 | 1 | 1350 | 3 | $H_2$ | 7.85 | 98 | 0.06 | 0.06 | A | A |
| Ex. 4 | 1 | 1350 | 3 | $H_2$ | 7.88 | 99 | 0.07 | 0.06 | A | A |
| Ex. 5 | 1 | 1350 | 3 | $H_2$ | 7.91 | 99 | 0.07 | 0.06 | A | A |
| Ex. 6 | 1 | 1350 | 3 | $H_2$ | 7.92 | 99. | 0.06 | 0.06 | A | A |
| Ex. 7 | 1 | 1350 | 3 | $H_2$ | 7.93 | 99 | 0.06 | 0.06 | A | A |
| Ex. 8 | 1 | 1350 | 3 | $H_2$ | 7.75 | 97 | 0.06 | 0.06 | B | A |
| Ex. 9 | 1 | 1350 | 3 | $H_2$ | 7.72 | 97 | 0.08 | 0.07 | C | B |
| Ex. 10 | 1 | 1350 | 3 | $H_2$ | 7.69 | 96 | 0.08 | 0.07 | B | A |
| Ex. 11 | 1 | 1350 | 3 | $H_2$ | 7.91 | 99 | 0.10 | 0.09 | A | A |
| Ex. 12 | 2 | 1350 | 3 | $H_2$ | 7.89 | 99 | 0.06 | 0.06 | A | A |
| Ex. 13 | 3 | 1350 | 3 | $H_2$ | 7.85 | 98 | 0.07 | 0.07 | A | A |
| Ex. 14 | 4 | 1350 | 3 | $H_2$ | 7.91 | 99 | 0.04 | 0.04 | A | A |
| Ex. 15 | 5 | 1350 | 3 | $H_2$ | 7.92 | 99 | 0.04 | 0.04 | A | A |
| Ex. 16 | 6 | 1350 | 3 | $H_2$ | 7.90 | 99 | 0.05 | 0.04 | A | A |
| Ex. 17 | 7 | 1350 | 3 | $H_2$ | 7.94 | 99 | 0.04 | 0.03 | A | A |
| Ex. 18 | 8 | 1350 | 3 | $H_2$ | 7.88 | 99 | 0.05 | 0.04 | A | A |
| Ex. 19 | 9 | 1350 | 3 | $H_2$ | 7.80 | 98 | 0.12 | 0.10 | A | A |
| Ex. 20 | 10 | 1350 | 3 | $H_2$ | 7.78 | 97 | 0.18 | 0.13 | A | A |
| Ex. 21 | 4 | 1350 | 3 | $H_2$ | 7.94 | 99 | 0.05 | 0.04 | A | A |
| Ex. 22 | 4 | 1350 | 3 | $H_2$ | 7.93 | 99 | 0.05 | 0.05 | A | A |
| Com. Ex. | 1 | 1350 | 3 | $H_2$ | — | — | — | — | C | D |
| Com. Ex.2 | 1 | 1350 | 3 | $H_2$ | 7.02 | 88 | 0.45 | 0.39 | C | D-C |
| Com. Ex.3 | 1 | 1350 | 3 | $H_2$ | 7.74 | 97 | 0.07 | 0.06 | D-C | C |
| Com. Ex.4 | 1 | 1350 | 3 | $H_2$ | 7.54 | 94 | 0.10 | 0.08 | D | D |
| Com. Ex.5 | 11 | 1350 | 3 | $H_2$ | 7.50 | 94 | 0.32 | 0.28 | B | C |
| Com. Ex.6 | 12 | 1350 | 3 | $H_2$ | 7.43 | 93 | 0.36 | 0.24 | B | C |

As can be clearly seen from Table 3, all the sintered bodies obtained in the respective Examples had a relative density of 96% or more and were in the form of dense bodies with low porosity.

Furthermore, the sintered bodies obtained in the respective Examples showed increased dimensional accuracy. Moreover, all the sintered bodies obtained in the respective Examples exhibited reduced metal oxide amount and improved aesthetic appearance.

In contrast, the sintered bodies obtained in the respective Comparative Examples 2 and 4 to 6 had a low relative density of 95% or less. Presumably, this is because debinding has occurred insufficiently for the reasons mentioned earlier. Insufficient debinding led to imperfect decomposition of the binders (first resin and second resin) and the additive or imperfect removal of the decomposed first resin, the decomposed second resin and the decomposed additive.

As the binder and the additive remaining in the brown bodies were quickly decomposed and discharged the decomposed first resin, the decomposed second resin and the decomposed additive from the brown bodies in the sintering step, the brown bodies (sintered bodies) were suffered from a change in shape and cracks were generated in the sintered bodies. Thus, it was confirmed that the sintered bodies obtained in the respective Comparative Examples exhibited very low dimensional accuracy and marred aesthetic appearance.

The exposing step was omitted in the method for producing the sintered body of Comparative Example 3. Therefore, it was considered that sintering was performed in a state that the first brown bodies contained a large quantity of ozone (i.e., in a state that high concentration ozone remains in the pores of the first brown bodies).

As a result, the oxidizing action of ozone was accelerated at an elevated temperature, thereby oxidizing the metallic material contained in the first brown bodies. Presumably, this increased the metal oxide amount in the sintered bodies.

With the sintered body production method of Comparative Example 4, the first brown bodies were exposed to an atmosphere of extremely high ozone concentration during the exposing step. Therefore, it was considered that first brown bodies were subjected to the second debinding step and the sintering step in a state that the first brown bodies contained a large quantity of ozone (i.e., in a state that high concentration ozone remains in the pores of the first brown bodies).

As a result, the oxidizing action of ozone was accelerated at an elevated temperature, thereby oxidizing the metallic material contained in the first brown bodies. Presumably, this increased the metal oxide amount in the sintered bodies.

In case where First Resin is Aliphatic Carbonic Ester-Based Resin

4. Preparation of Green Body

Specified number of (two hundred) green bodies were prepared for each of Sample Numbers set forth below.

Sample No. 13

SUS316L powder produced by a water atomizing method and butane diol polycarbonate (having a weight-average molecular weight of 50,000) were mixed with each other and kneaded to obtain a compound, by use of a pressure kneader (kneading machine) under the following kneading conditions: a kneading temperature of 200° C.; a kneading time of 0.75 hours; and an atmosphere of nitrogen gas.

The SUS316L powder used had an average particle size of 10 μm. The mixing ratio of the SUS316L powder and other components (the binder and the additive) was 93:7 by weight.

Then, the compound was pulverized into pellets having an average particle size of 3 mm. Green bodies of Sample No. 13 were obtained by repeatedly injection-molding the pellets with an injection molding machine under the following molding conditions: materials (pellets) temperature of 210° C.; and an injection pressure of 10.8 MPa (110 kgf/cm$^2$).

The green bodies were formed of a cubic shape having a size of 15×15×15 mm. Each of the green bodies has a through-hole formed by the injection molding machine. The through-hole was formed to penetrate the center portions of two opposite surfaces of each of the green bodies. The through-hole had an inner diameter of 5 mm.

Sample Nos. 14 to 22

Green bodies of Sample Nos. 14 to 22 were prepared in the same manner as applied to preparation of the green bodies of Sample No. 13, except that the mixing ratio of the components other than the SUS316L powder (i.e., the binder and the additive) and the composition of the binder were changed as shown in Table 4.

Sample Nos. 23 and 24

Green bodies of Sample Nos. 23 and 24 were prepared in the same manner as applied to preparation of the green bodies of Sample No. 13, except that the mixing ratio of the components other than the SUS316L powder (i.e., the binder and the additive) and the composition of the binder were changed as shown in Table 4.

5. Production of Sintered Body

Example 23

First brown bodies were obtained by debinding the green bodies of Sample No. 13 (in a first debinding step) under the following conditions: a temperature of 150° C.; a time period of 20 hours; and an atmosphere of ozone-containing nitrogen gas (with an ozone concentration of 20 ppm).

Intermediate brown bodies were then obtained by exposing the first brown bodies to a nitrogen gas (in an exposing step) under the following conditions: a temperature of 100° C.; a time period of 1 hour; and an atmosphere of nitrogen gas.

The continuous furnace as illustrated in FIG. 7 was used in the first debinding step and the exposing step. Subsequently, sintered bodies were obtained by sintering the intermediate brown bodies with the continuous furnace as illustrated in FIG. 7 under the following conditions: a temperature of 1,350° C.; a time period of 3 hours; and an atmosphere of hydrogen gas.

Examples 24 to 35

Sintered bodies were obtained in the same manner as in Example 23, except that the sample numbers of the green bodies, the conditions of the first debinding step and the conditions of the exposing step were respectively changed as shown in Table 5.

Example 36

The first brown bodies were obtained by exposing the green bodies of Sample No. 16 to an ozone-containing nitro-

TABLE 4

| | | Mixing Ratio (Weight Ratio) of Metal Powder and Components | | Composition and Mixing Ratio (Weight Ratio) of Components other than Metal Powder | | | | |
|---|---|---|---|---|---|---|---|---|
| | | Other than Metal Powder | | Binder | | | | |
| | Composition of | | Components Other than | First Resin (Aliphatic Carbonic Ester-Based Resin) | | Second Rsesin | | Additive |
| Sample No. | Metal Powder | Metal Powder | Metal Powder | Butane Diol Polycarbonate (Mw: 50,000) | Propane Diol Polycabonate (Mw: 50,000) | Polystylene (MW: 10,000) | Polyethylene (Mw: 300,000) | Stearic Acid |
| 13 | SUS316L | 93 | 7 | 100 | — | — | — | — |
| 14 | SUS316L | 93 | 7 | — | 100 | — | — | — |
| 15 | SUS316L | 93 | 7 | 75 | 25 | — | — | — |
| 16 | SUS316L | 93 | 7 | 90 | — | 10 | — | — |
| 17 | SUS316L | 93 | 7 | 90 | — | — | 10 | — |
| 18 | SUS316L | 93 | 7 | 90 | — | 5 | 5 | — |
| 19 | SUS316L | 93 | 7 | 90 | — | 9 | — | 1 |
| 20 | SUS316L | 93 | 7 | 50 | — | 50 | — | — |
| 21 | SUS316L | 93 | 7 | 20 | — | 75 | — | 5 |
| 22 | SUS316L | 93 | 7 | 15 | — | 80 | — | 5 |
| 23 | SUS316L | 93 | 7 | — | — | 95 | — | 5 |
| 24 | SUS316L | 93 | 7 | — | — | 50 | 50 | — |

gen gas (in a first debinding step) in the same manner as in Example 26. The intermediate brown bodies were obtained by exposing the first brown bodies thus obtained to a nitrogen gas (in an exposing step) in the same manner as in Example 26. Then, second brown bodies were obtained by exposing the intermediate brown bodies to a hydrogen gas (in a second debinding step) under the following conditions: a temperature of 500° C.; a time period of 1 hour; and an atmosphere of hydrogen gas. Sintered bodies were obtained by sintering the second brown bodies in the same manner as in Example 26.

Examples 37 to 42

Sintered bodies were obtained in the same manner as in Example 36, except that the sample numbers of the green bodies and the conditions of the second debinding step were respectively changed as shown in Table 5.

Example 43

Sintered bodies were obtained in the same manner as in Example 36, except that the continuous furnace shown in FIG. 8 was used and further that the concentration of ozone contained in the ozone-containing nitrogen gas within a first debinding zone of the continuous furnace was continuously decreased from 1,000 ppm to 50 ppm.

Example 44

Sintered bodies were obtained in the same manner as in Example 36, except that the continuous furnace shown in FIG. 9 was used and further that the concentration of ozone contained in the ozone-containing nitrogen gas within a first debinding zone of the continuous furnace was continuously decreased from 1,000 ppm to 50 ppm.

Comparative Example 7

Sintered bodies were obtained in the same manner as in Example 23, except that the ozone concentration was changed to 0 ppm.

Comparative Example 8

Sintered bodies were obtained in the same manner as in Example 23, except that the ozone concentration was changed to 0 ppm and further that the time period for the first debinding step was changed to 80 hours.

Comparative Example 9

Sintered bodies were obtained in the same manner as in Example 26, except that the exposing step was omitted.

Comparative Example 10

Sintered bodies were obtained in the same manner as in Example 30, except that the time period for the first debinding step was changed to 6 hours and further that the ozone concentration in the atmosphere of the exposing step was changed to 20,000 ppm.

Comparative Examples 11 and 12

Sintered bodies were obtained in the same manner as in Example 36, except that the sample numbers of the green bodies and the conditions of the second debinding step were respectively changed as shown in Table 5.

6. Evaluation 6-1. Evaluation of Weight Loss Percentage

First, the weight of the green bodies prepared in Examples 23 to 44 and Comparative Examples 7 to 12 was measured by an electronic weighing scale. Then, the weight of the first brown bodies of the Examples 23 to 44 and the Comparative Examples 7 to 12 obtained in the first debinding step was measured by the electronic weighing scale.

The weight loss quantity of the green bodies in the first debinding step was calculated based on the weight of the green bodies and the first brown bodies. The weight loss percentage of the green bodies in the first debinding step was found based on the weight loss quantity of the green bodies and the weight thereof.

Furthermore, the weight of the intermediate brown bodies obtained in Examples 36 to 44 and Comparative Examples 11 and 12 was measured by the electronic weighing scale. Then, the weight of the second brown bodies obtained in the second debinding step was measured by the electronic weighing scale.

The weight loss quantity of the intermediate brown bodies in the second debinding step was calculated based on the weight of the intermediate brown bodies and the second brown bodies. The weight loss percentage of the intermediate brown bodies in the second debinding step was found based on the weight loss quantity of the intermediate brown bodies and the weight thereof.

In respect of the respective Examples and the respective Comparative Examples, the weight loss percentage in the first debinding step and the weight loss percentage in the second debinding step were summed up, consequently calculating the weight loss percentage of the debinding steps as a whole.

In respect of the respective Examples and the respective Comparative Examples, the weight loss percentage of the debinding steps as a whole was divided by the ratio of the components other than the metal powder shown in Table 5, thereby calculating the removal percentage of the components other than the metal powder (the binder and the additive).

Moreover, the time required in the debinding steps as a whole was measured. The evaluation results are shown in Table 5.

TABLE 5

| | | Producing Conditions | | | | | | | | | | |
|---|---|---|---|---|---|---|---|---|---|---|---|---|
| | | First Debinding Step | | | | Exposing Step | | | | Second Debinding Step | | |
| | Sample No. | Temp. [° C.] | Time [hr] | Atmosphere | Ozone Concentration [ppm] | Temp. [° C. | Time [hr] | Atmosphere | Ozone Concentration [ppm] | Temp. [° C.] | Time [hr] | Atmosphere |
| Ex. 23 | 13 | 150 | 20 | $O_3/N_2$ | 20 | 100 | 1 | $N_2$ | 0 | — | — | — |
| Ex. 24 | 13 | 150 | 10 | $O_3/N_2$ | 50 | 100 | 1 | $N_2$ | 0 | — | — | — |
| Ex. 25 | 13 | 150 | 8 | $O_3/N_2$ | 300 | 100 | 1 | $N_2$ | 0 | — | — | — |

TABLE 5-continued

| | | | | | | | | | | | | |
|---|---|---|---|---|---|---|---|---|---|---|---|---|
| Ex. 26 | 13 | 150 | 6 | $O_3/N_2$ | 1000 | 100 | 1 | $N_2$ | 0 | — | — | — |
| Ex. 27 | 13 | 150 | 5 | $O_3/N_2$ | 5000 | 100 | 1 | $N_2$ | 0 | — | — | — |
| Ex. 28 | 13 | 150 | 4 | $O_3/N_2$ | 8000 | 100 | 1 | $N_2$ | 0 | — | — | — |
| Ex. 29 | 13 | 150 | 4 | $O_3/N_2$ | 10000 | 100 | 1 | $N_2$ | 0 | — | — | — |
| Ex. 30 | 13 | 150 | 4 | $O_3/N_2$ | 10000 | 100 | 1 | $O_3/N_2$ | 50 | — | — | — |
| Ex. 31 | 13 | 150 | 4 | $O_3/N_2$ | 10000 | 150 | 1 | $O_3/N_2$ | 500 | — | — | — |
| Ex. 32 | 13 | 50 | 15 | $O_3/N_2$ | 1000 | 100 | 1 | $N_2$ | 0 | — | — | — |
| Ex. 33 | 13 | 190 | 4 | $O_3/N_2$ | 1000 | 100 | 1 | $N_2$ | 0 | — | — | — |
| Ex. 34 | 14 | 150 | 5 | $O_3/N_2$ | 5000 | 100 | 1 | $N_2$ | 0 | — | — | — |
| Ex. 35 | 15 | 150 | 5 | $O_3/N_2$ | 5000 | 100 | 1 | $N_2$ | 0 | — | — | — |
| Ex. 36 | 16 | 150 | 6 | $O_3/N_2$ | 1000 | 100 | 1 | $N_2$ | 0 | 500 | 1 | $H_2$ |
| Ex. 37 | 17 | 150 | 6 | $O_3/N_2$ | 1000 | 100 | 1 | $N_2$ | 0 | 500 | 1 | $H_2$ |
| Ex. 38 | 18 | 150 | 6 | $O_3/N_2$ | 1000 | 100 | 1 | $N_2$ | 0 | 500 | 1 | $H_2$ |
| Ex. 39 | 19 | 150 | 6 | $O_3/N_2$ | 1000 | 100 | 1 | $N_2$ | 0 | 500 | 1 | $H_2$ |
| Ex. 40 | 20 | 150 | 6 | $O_3/N_2$ | 1000 | 100 | 1 | $N_2$ | 0 | 500 | 1 | $H_2$ |
| Ex. 41 | 21 | 150 | 6 | $O_3/N_2$ | 1000 | 100 | 1 | $N_2$ | 0 | 500 | 2 | $H_2$ |
| Ex. 42 | 22 | 150 | 6 | $O_3/N_2$ | 1000 | 100 | 1 | $N_2$ | 0 | 500 | 2 | $H_2$ |
| Ex. 43 | 16 | 150 | 6 | $O_3/N_2$ | 1000→50 | 100 | 1 | $N_2$ | 0 | 500 | 1 | $H_2$ |
| Ex. 44 | 16 | 150 | 6 | $O_3/N_2$ | 1000→50 | — | — | — | — | 500 | 1 | $H_2$ |
| Com. Ex. 7 | 13 | 150 | 20 | $N_2$ | 0 | 100 | 1 | $N_2$ | 0 | — | — | — |
| Com. Ex. 8 | 13 | 150 | 80 | $N_2$ | 0 | 100 | 1 | $N_2$ | 0 | — | — | — |
| Com Ex. 9 | 13 | 150 | 6 | $O_3/N_2$ | 1000 | — | — | — | — | — | — | — |
| Com. Ex. 10 | 13 | 150 | 6 | $O_3/N_2$ | 10000 | 100 | 1 | $O_3/N_2$ | 20000 | — | — | — |
| Com. Ex. 11 | 23 | 150 | 6 | $O_3/N_2$ | 1000 | 100 | 1 | $N_2$ | 0 | 500 | 5 | $H_2$ |
| Com. Ex. 12 | 24 | 150 | 6 | $O_3/N_2$ | 1000 | 100 | 1 | $N_2$ | 0 | 500 | 5 | $H_2$ |

| | | Evaluation Results | | | | |
|---|---|---|---|---|---|---|
| | | First | Second | Debinding Steps as Whole | | |
| | Sample No. | Debinding Step Weight Loss Percentage [wt %] | Debinding Step Weight Loss Percentage [wt %] | Weight Loss Percentage [wt %] | Removal Percentage of Components Other than Metal Powder [wt %] | Time Required [hr] |
| Ex. 23 | 13 | 6.68 | — | 6.68 | 95.4 | 21 |
| Ex. 24 | 13 | 6.83 | — | 6.83 | 97.6 | 11 |
| Ex. 25 | 13 | 6.88 | — | 6.88 | 98.3 | 9 |
| Ex. 26 | 13 | 6.92 | — | 6.92 | 98.9 | 7 |
| Ex. 27 | 13 | 6.90 | — | 6.90 | 98.6 | 6 |
| Ex. 28 | 13 | 6.93 | — | 6.93 | 99.0 | 5 |
| Ex. 29 | 13 | 6.95 | — | 6.95 | 99.3 | 5 |
| Ex. 30 | 13 | 6.93 | — | 6.93 | 99.0 | 5 |
| Ex. 31 | 13 | 6.96 | — | 6.96 | 99.4 | 5 |
| Ex. 32 | 13 | 6.71 | — | 6.71 | 95.9 | 16 |
| Ex. 33 | 13 | 6.94 | — | 6.94 | 99.1 | 5 |
| Ex. 34 | 14 | 6.87 | — | 6.87 | 98.1 | 6 |
| Ex. 35 | 15 | 6.90 | — | 6.90 | 98.6 | 6 |
| Ex. 36 | 16 | 6.15 | 0.78 | 6.93 | 99.0 | 8 |
| Ex. 37 | 17 | 6.20 | 0.74 | 6.94 | 99.1 | 8 |
| Ex. 38 | 18 | 6.21 | 0.72 | 6.93 | 99.0 | 8 |
| Ex. 39 | 19 | 6.19 | 0.73 | 6.92 | 98.9 | 8 |
| Ex. 40 | 20 | 3.45 | 3.48 | 6.93 | 99.0 | 8 |
| Ex. 41 | 21 | 1.38 | 5.56 | 6.94 | 99.1 | 9 |
| Ex. 42 | 22 | 1.03 | 5.78 | 6.81 | 97.3 | 9 |
| Ex. 43 | 16 | 6.27 | 0.69 | 6.96 | 99.4 | 8 |
| Ex. 44 | 16 | 6.26 | 0.69 | 6.95 | 99.3 | 7 |
| Com. Ex. 7 | 13 | 0.25 | — | 0.25 | 3.6 | 21 |
| Com. Ex. 8 | 13 | 1.12 | — | 1.12 | 16.0 | 81 |
| Com Ex. 9 | 13 | 6.84 | — | 6.84 | 97.7 | 6 |
| Com. Ex. 10 | 13 | 6.90 | — | 6.90 | 98.6 | 7 |
| Com. Ex. 11 | 23 | 0.21 | 5.84 | 6.05 | 86.4 | 12 |
| Com. Ex. 12 | 24 | 0.38 | 5.99 | 6.37 | 91.0 | 12 |

As is apparent from Table 5, 95% or more of the binder and the additive were removed in the debinding steps (first and second debinding steps) of the respective Examples. This means that debinding was performed in a reliable manner.

Furthermore, in the respective Examples, it was possible to shorten the time required in the debinding steps as a whole, although the shortened time varied slightly with the composition of the binder, the ozone concentration in the atmosphere of the first debinding step and the temperature of the atmosphere.

This is because the tasks of decomposing the aliphatic carbonic ester-based resin and removing the decomposed aliphatic carbonic ester-based resin were performed quickly in the first debinding step, eventually assuring quick decomposition of the second resin and rapid removal of the decomposed second resin.

In case of the green bodies whose binder contained the aliphatic carbonic ester-based resin in a large percentage, the decomposition efficiency of the binder grew high, thereby greatly shortening the processing time.

Turning to the Comparative Examples, one half or more of the binder remained in the green bodies in case of Comparative Examples 7 and 8, despite the fact that debinding was performed for a long period of time. Thus, debinding occurred insufficiently.

This is because no ozone was contained in the atmosphere of the first debinding step and because the aliphatic carbonic ester-based resin remained in the green bodies in a large quantity with no progress of decomposition of the aliphatic carbonic ester-based resin and removal of the decomposed aliphatic carbonic ester-based resin.

The green bodies used in Comparative Examples 11 and 12 did not contain the aliphatic carbonic ester-based resin. For this reason, the binder was not sufficiently decomposed in the first debinding step even at a low temperature of 150° C. Thus, debinding did not occur sufficiently even when the second debinding step was performed for a long period of time.

6-2. Evaluation of Density of Sintered Body

Density was measured for the sintered bodies obtained in the respective Examples and the respective Comparative Examples. The density measurement was conducted using Archimedes' principle (defined in JIS Z 2505). One hundred samples (sintered bodies) of each of the respective Examples and the respective Comparative Examples were subjected to the density measurement.

An average value of the density thus measured were calculated and shown in Table 6. Then, the relative density of the sintered bodies was calculated using the measured values. Calculation of the relative density was made on the basis of the density (theoretical density) of SUS316L, i.e., 7.98 g/cm$^3$.

6-3. Evaluation of Dimensional Accuracy of Sintered Body

Width (mm) was measured for one hundred sintered bodies of each of the respective Examples and the respective Comparative Examples. The width measurement was conducted using a micrometer. An average value was found based on the measured width for every one hundred sintered bodies. The difference between the average value and the width deviating greatest from the average value was referred to as a variation.

Then, circularity of center holes was measured for the sintered bodies obtained in the respective Examples and the respective Comparative Examples. The circularity measurement was conducted using a three-dimensional measuring instrument (made and sold by Mitsutoyo Corporation, Japan, under a model number FT805).

One hundred samples (sintered bodies) of each of the respective Examples and the respective Comparative Examples were subjected to the circularity measurement. An average value of the circularity for every one hundred measured values were calculated and shown in Table 6.

Measurement of density and size was omitted with respect to the sintered bodies of Comparative Example 7, because cracks were generated in almost all the one hundred sintered bodies.

6-4. Evaluation of Oxide Amount of Sintered Body

First, the sintered bodies obtained in the respective Examples and the respective Comparative Examples were cut to conduct the following analysis of oxygen amount and observation of the cut surfaces.

6-4-1. Oxygen amount of the respective sintered bodies was analyzed.

6-4-2. The cut surfaces of the respective sintered bodies were subjected to grinding and then observed by use of a scanning electron microscopy (SEM). As a result, it was recognized that oxide particles exist in observation images of the cut surfaces.

Based on the analysis and observation conducted above, metal oxide amount in the respective sintered bodies was evaluated and identified by: "A" if the metal oxide amount was extremely small; "B" if the metal oxide amount was small; "C" if the metal oxide amount was a little great; and "D" if the metal oxide amount was extremely great.

6-5. Evaluation of Aesthetic Appearance of Sintered Body

Evaluation of aesthetic appearance was conducted for the (one hundred) sintered bodies obtained in the respective Examples and the respective Comparative Examples. Aesthetic appearance of the sintered bodies was observed with naked eyes.

The evaluation results of aesthetic appearance are identified by: "A" if none of the sintered bodies contained marks or cracks (including micro-cracks); "B" if a few sintered bodies contained marks or cracks (including micro-cracks); "C" if the majority of the sintered bodies contained marks or cracks (including micro-cracks); and "D" if almost all the sintered bodies contained cracks. The evaluation results of the above items 6-2 to 6-5 are shown in Table 6.

TABLE 6

| | | Conditions of Sintering Step | | | Evaluation Results of Sintered Body | | | | | |
|---|---|---|---|---|---|---|---|---|---|---|
| | | | | | Density | | Dimensional Accuracy | | | |
| | Sample No. | Temp. [° C.] | Time [hr] | Atmosphere | Measured Values [g/cm$^3$] | Relative Density [%] | Width (Variation) [mm] | Circularity [mm] | Oxide Amount | Aesthetic Appearance |
| Ex. 23 | 13 | 1350 | 3 | $H_2$ | 7.68 | 96 | 0.11 | 0.10 | A | A |
| Ex. 24 | 13 | 1350 | 3 | $H_2$ | 7.74 | 97 | 0.08 | 0.07 | A | A |
| Ex. 25 | 13 | 1350 | 3 | $H_2$ | 7.84 | 98 | 0.08 | 0.05 | A | A |
| Ex. 26 | 13 | 1350 | 3 | $H_2$ | 7.89 | 99 | 0.07 | 0.06 | A | A |
| Ex. 27 | 13 | 1350 | 3 | $H_2$ | 7.87 | 99 | 0.07 | 0.05 | A | A |

TABLE 6-continued

| | | Conditions of Sintering Step | | | Evaluation Results of Sintered Body | | | | | |
|---|---|---|---|---|---|---|---|---|---|---|
| | | | | | Density | | Dimensional Accuracy | | | |
| | Sample No. | Temp. [° C.] | Time [hr] | Atmosphere | Measured Values [g/cm$^3$] | Relative Density [%] | Width (Variation) [mm] | Circularity [mm] | Oxide Amount | Aesthetic Appearance |
| Ex. 28 | 13 | 1350 | 3 | $H_2$ | 7.91 | 99 | 0.06 | 0.05 | A | A |
| Ex. 29 | 13 | 1350 | 3 | $H_2$ | 7.90 | 99 | 0.06 | 0.06 | A | A |
| Ex. 30 | 13 | 1350 | 3 | $H_2$ | 7.77 | 97 | 0.07 | 0.06 | B | A |
| Ex. 31 | 13 | 1350 | 3 | $H_2$ | 7.69 | 96 | 0.10 | 0.08 | C | B |
| Ex. 32 | 13 | 1350 | 3 | $H_2$ | 7.73 | 97 | 0.09 | 0.08 | B | A |
| Ex. 33 | 13 | 1350 | 3 | $H_2$ | 7.88 | 99 | 0.12 | 0.10 | A | A |
| Ex. 34 | 14 | 1350 | 3 | $H_2$ | 7.89 | 99 | 0.07 | 0.07 | A | A |
| Ex. 35 | 15 | 1350 | 3 | $H_2$ | 7.88 | 99 | 0.08 | 0.07 | A | A |
| Ex. 36 | 16 | 1350 | 3 | $H_2$ | 7.92 | 99 | 0.04 | 0.04 | A | A |
| Ex. 37 | 17 | 1350 | 3 | $H_2$ | 7.92 | 99 | 0.05 | 0.04 | A | A |
| Ex. 38 | 18 | 1350 | 3 | $H_2$ | 7.93 | 99 | 0.05 | 0.04 | A | A |
| Ex. 39 | 19 | 1350 | 3 | $H_2$ | 7.94 | 99 | 0.04 | 0.03 | A | A |
| Ex. 40 | 20 | 1350 | 3 | $H_2$ | 7.91 | 99 | 0.04 | 0.04 | A | A |
| Ex. 41 | 21 | 1350 | 3 | $H_2$ | 7.81 | 98 | 0.09 | 0.07 | A | A |
| Ex. 42 | 22 | 1350 | 3 | $H_2$ | 7.84 | 98 | 0.20 | 0.15 | A | A |
| Ex. 43 | 16 | 1350 | 3 | $H_2$ | 7.93 | 99 | 0.04 | 0.04 | A | A |
| Ex. 44 | 16 | 1350 | 3 | $H_2$ | 7.91 | 99 | 0.06 | 0.04 | A | A |
| Com. Ex. 7 | 13 | 1350 | 3 | $H_2$ | — | — | — | — | C | D |
| Com. Ex. 8 | 13 | 1350 | 3 | $H_2$ | 7.23 | 91 | 0.57 | 0.50 | C | D-C |
| Com. Ex. 9 | 13 | 1350 | 3 | $H_2$ | 7.79 | 98 | 0.09 | 0.05 | D | C |
| Com. Ex. 10 | 13 | 1350 | 3 | $H_2$ | 7.44 | 93 | 0.15 | 0.09 | D | D |
| Com. Ex. 11 | 23 | 1350 | 3 | $H_2$ | 7.60 | 95 | 0.25 | 0.21 | B | C |
| Com. Ex. 12 | 24 | 1350 | 3 | $H_2$ | 7.51 | 94 | 0.30 | 0.22 | B | C |

As can be clearly seen from Table 6, all the sintered bodies obtained in the respective Examples had a relative density of 96% or more and were in the form of dense bodies with low porosity.

Furthermore, the sintered bodies obtained in the respective Examples showed increased dimensional accuracy. Moreover, all the sintered bodies obtained in the respective Examples exhibited reduced metal oxide amount and improved aesthetic appearance.

In contrast, the sintered bodies obtained in the respective Comparative Examples 2, 4 and 6 had a low relative density of 95% or less. Presumably, this is because debinding has occurred insufficiently for the reasons mentioned earlier. Insufficient debinding led to imperfect decomposition of the binders (first resin and second resin) and the additive or imperfect removal of the decomposed first resin, the decomposed second resin and the decomposed additive.

As the binder and the additive remaining in the brown bodies were quickly decomposed and discharged the decomposed first resin, the decomposed second resin and the decomposed additive from the brown bodies in the sintering step, the brown bodies (sintered bodies) were suffered from a change in shape and cracks were generated in the sintered bodies. Thus, it was confirmed that the sintered bodies obtained in the respective Comparative Examples exhibited very low dimensional accuracy and marred aesthetic appearance.

The exposing step was omitted in the method for producing the sintered body of Comparative Example 9. Therefore, it was considered that sintering was performed in a state that the first brown bodies contained a large quantity of ozone (i.e., in a state that high concentration ozone remains in the pores of the first brown bodies).

As a result, the oxidizing action of ozone was accelerated at an elevated temperature, thereby oxidizing the metallic material contained in the first brown bodies. Presumably, this increased the metal oxide amount in the sintered bodies.

With the sintered body production method of Comparative Example 10, the first brown bodies were exposed to an atmosphere of extremely high ozone concentration during the exposing step. Therefore, it was considered that first brown bodies were subjected to the second debinding step and the sintering step in a state that the first brown bodies contained a large quantity of ozone (i.e., in a state that high concentration ozone remains in the pores of the first brown bodies).

As a result, the oxidizing action of ozone was accelerated at an elevated temperature, thereby oxidizing the metallic material contained in the first brown bodies. Presumably, this increased the metal oxide amount in the sintered bodies.

What is claimed is:

1. A method for producing a sintered body comprising:

forming a green body by molding a composition for forming a green body into a specified shape to obtain the green body, the composition comprising powder constituted of a metallic material and a binder containing a first resin which is decomposable by ozone;

first debinding the green body by exposing the green body to a high ozone content atmosphere to decompose the first resin and remove the decomposed first resin form the green body to obtain a brown body;

exposing the thus obtained brown body at least once to a low ozone content atmosphere whose ozone concentration is lower than an ozone concentration of the high ozone content atmosphere to obtain an intermediate brown body; and sintering the intermediate brown body which has been exposed to the low ozone content atmosphere to obtain the sintered body, wherein the low ozone content atmosphere is set at a lower temperature than the temperature of the high ozone content atmosphere.

2. The method for producing the sintered body as claimed in claim 1, wherein the ozone concentration of the high ozone content atmosphere is 50 to 10,000 ppm.

3. The method for producing the sintered body as claimed in claim 1, wherein the high ozone content atmosphere is set at a temperature of 20 to 190° C.

4. The method for producing the sintered body as claimed in claim 1, wherein the first resin contains at least one of a polyether-based resin, a polylactate-based resin and an aliphatic carbonic ester-based resin.

5. The method for producing the sintered body as claimed in claim 4, wherein the first resin contains a polyether-based resin, and wherein the polyether-based resin contains a polyacetal-based resin as a main component thereof.

6. The method for producing the sintered body as claimed in claim 4, wherein each of repeating units of the aliphatic carbonic ester-based resin has a carbonic ester group, wherein the number of the carbon atoms contained in the unit other than carbon atoms of the carbonic ester group is 2 to 11.

7. The method for producing the sintered body as claimed in claim 4, wherein the aliphatic carbonic ester-based resin has no unsaturated bond.

8. The method for producing the sintered body as claimed in claim 1, wherein the first resin has a weight-average molecular weight of 10,000 to 300,000.

9. The method for producing the sintered body as claimed in claim 1, wherein the amount of the first resin contained in the binder is 20 wt % or more.

10. The method for producing the sintered body as claimed in claim 1, wherein the exposing step has at least a first stage and a second stage which is subsequent to the first stage, wherein the low ozone content atmosphere in the second stage of the exposing step contains substantially no ozone.

11. The method for producing the sintered body as claimed in claim 1, wherein the low ozone content atmosphere contains non-oxidizing gas as a main component thereof except for ozone.

12. The method for producing the sintered body as claimed in claim 1, wherein the first debinding step, the exposing step and the sintering step are carried out continuously by using a continuous furnace.

13. A method for producing a sintered body comprising:

forming a green body by molding a composition for forming a green body into a specified shape to obtain the green body, the composition comprising powder constituted of a metallic material and a binder containing a first resin which is decomposable by ozone;

first debinding the green body by exposing the green body to a high ozone content atmosphere to decompose the first resin and remove the decomposed first resin form the green body to obtain a brown body;

exposing the thus obtained brown body at least once to a low ozone content atmosphere whose ozone concentration is lower than an ozone concentration of the high ozone content atmosphere to obtain an intermediate brown body; and sintering the intermediate brown body which has been exposed to the low ozone content atmosphere to obtain the sintered body, wherein the first debinding step, the exposing step and the sintering step are carried out continuously by using a continuous furnace, and wherein the continuous furnace has a space in which an ozone concentration is decreased from a midway point in a moving direction of the green body and wherein the debinding step and the exposing step are carried out continuously by passing through the green body in the space.

14. The method for producing the sintered body as claimed in claim 13, wherein the ozone concentration in the space changes continuously along the moving direction of the green body.

15. The method for producing the sintered body as claimed in claim 1, wherein the binder further contains a second resin of which thermal decomposition temperature is higher than a melting point of the first resin, wherein the method further comprises second debinding the intermediate brown body which has been exposed to the low ozone content atmosphere by heating the intermediate brown body to decompose the second resin and remove the decomposed second resin from the intermediate brown body.

16. The method for producing the sintered body as claimed in claim 15, wherein the heating of the intermediate brown body in the second debinding step is carried out at a temperature of 180 to 600° C.

17. The method for producing the sintered body as claimed in claim 15, wherein the second debinding step carried out in an atmosphere containing reducing gas as a main component thereof.

18. The method for producing the sintered body as claimed in claim 15, the second resin contains at least one of polystyrene and polyolefin as a main component thereof.

19. The method for producing the sintered body as claimed in claim 15, the composition further contains an additive, wherein the additive is decomposed together with the second resin, and the decomposed additive is removed together with the decomposed second resin from the intermediate brown body in the second debinding step.

20. The method for producing the sintered body as claimed in claim 19, the additive contains a dispersant for increasing dispersibility of particles of the powder in the composition.

21. The method for producing the sintered body as claimed in claim 20, the dispersant contains higher fatty acid as a main component thereof.

22. The method for producing the sintered body as claimed in claim 21, wherein the higher fatty acid has carbon atoms of 16 to 30.

23. The method for producing the sintered body as claimed in claim 15, wherein the first debinding step, the exposing step, the second debinding step and the sintering step are carried out continuously by using a continuous furnace.

24. The method for producing the sintered body as claimed in claim 1, the green body is formed by an injection molding method or an extrusion molding method in the green body forming step.

* * * * *